US007711288B2

(12) United States Patent
Saiki et al.

(10) Patent No.: US 7,711,288 B2
(45) Date of Patent: May 4, 2010

(54) DEVELOPER STORING CONTAINER, METHOD OF ASSEMBLING DEVELOPER STORING CONTAINER AND METHOD OF RECYCLING DEVELOPER STORING CONTAINER

(75) Inventors: Atsuna Saiki, Saitama (JP); Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 275 days.

(21) Appl. No.: 11/774,920

(22) Filed: Jul. 9, 2007

(65) Prior Publication Data

US 2008/0152379 A1 Jun. 26, 2008

(30) Foreign Application Priority Data

Dec. 25, 2006 (JP) ..... 2006-348347

(51) Int. Cl.
*G03G 15/06* (2006.01)
*G03G 15/00* (2006.01)

(52) U.S. Cl. ..... 399/120; 399/109

(58) Field of Classification Search ..... 399/106, 399/109, 119, 120, 262, 263
See application file for complete search history.

(56) References Cited

U.S. PATENT DOCUMENTS

| | | | | |
|---|---|---|---|---|
| 5,493,366 | A * | 2/1996 | Satoh et al. | 399/120 X |
| 6,418,284 | B1 * | 7/2002 | Mercer | 399/120 |
| 6,804,484 | B2 * | 10/2004 | Hashimoto et al. | 399/120 |
| 6,904,249 | B2 * | 6/2005 | Kato et al. | 399/120 |

FOREIGN PATENT DOCUMENTS

| | | |
|---|---|---|
| JP | 5-107918 A | 4/1993 |
| JP | 08-044179 A | 2/1996 |
| JP | 11-153901 A | 6/1999 |

OTHER PUBLICATIONS

Australian Office Action Issued Nov. 12, 2008.

* cited by examiner

*Primary Examiner*—Sandra L Brase
(74) *Attorney, Agent, or Firm*—Sughrue Mion, PLLC

(57) ABSTRACT

A developer storing container includes: a first storing member including a first storing portion for storing a supplied developer; a second storing member including a second storing portion for storing a collected developer; and a partition member that connects the first storing portion and the second storing member so as to sandwich the partition member therebetween, and that separates the first and second storing portions from each other.

20 Claims, 31 Drawing Sheets

DEVELOPER STORING CONTAINER, METHOD OF ASSEMBLING DEVELOPER STORING CONTAINER AND METHOD OF RECYCLING DEVELOPER STORING CONTAINER

CROSS-REFERENCE TO RELATED APPLICATION

This application is based on and claims priority under 35 USC §119 from Japanese Patent Application No. 2006-348347 filed Dec. 25, 2006.

BACKGROUND (i) Technical Field

The present invention relates to a developer storing container such as a toner cartridge, a method of assembling a developer storing container, and a me hod of recycling a developer storing container.

(ii) Related Art

Developer storing containers used in image forming apparatus employing the electro-photographic method according to the related art such as copiers, printers, and facsimile machines include containers configured to supply developer stored in a supplied developer-storing portion thereof to a developing device mounted in an image forming apparatus at a timing and to collect developer to be collected including a carrier, which has been deteriorated by being used at a developing step in the developing device, into a collected developer-storing portion from the developing device.

In such a developer storing container, not only developer to be supplied to a developing device but also developer collected from the developer must be stored. Therefore, the interior of the developer storing container must be partitioned by a partition member into a supplied developer-storing portion and a collected developer-storing portion to store the supplied developer and the collected developer such that the supplied developer and the collected developer will not be mixed.

In the initial state of the developer storing container, the collected developer-storing portion is vacant whereas the supplied developer-storing portion is substantially fully filled with the developer. As the container is used, the amount of the supplied developer in the supplied developer-storing portion gradually decreases, and the amount of the developer collected into the collected developer-storming portion gradually increases.

SUMMARY

According to an aspect of the invention, there is provided a developer storing container comprising:

a first storing member (a supplied developer-storing member) including a first storing portion (a supplied developer-storing portion) for storing a supplied developer;

a second storing member (a collected developer-storing member) including a second storing portion (a collected developer-storing portion) for storing a collected developer; and a partition member that connects the first storing portion and the second storing member so as to sandwich the partition member therebetween, and that separates the first and second storing portions from each other.

BRIEF DESCRIPTION OF THE DRAWINGS

Embodiments of the present invention will be described in detail based on the following figures, wherein.

DETAILED DESCRIPTION

An exemplary embodiment of the invention will now be described with reference to the drawings.

Figure 2:
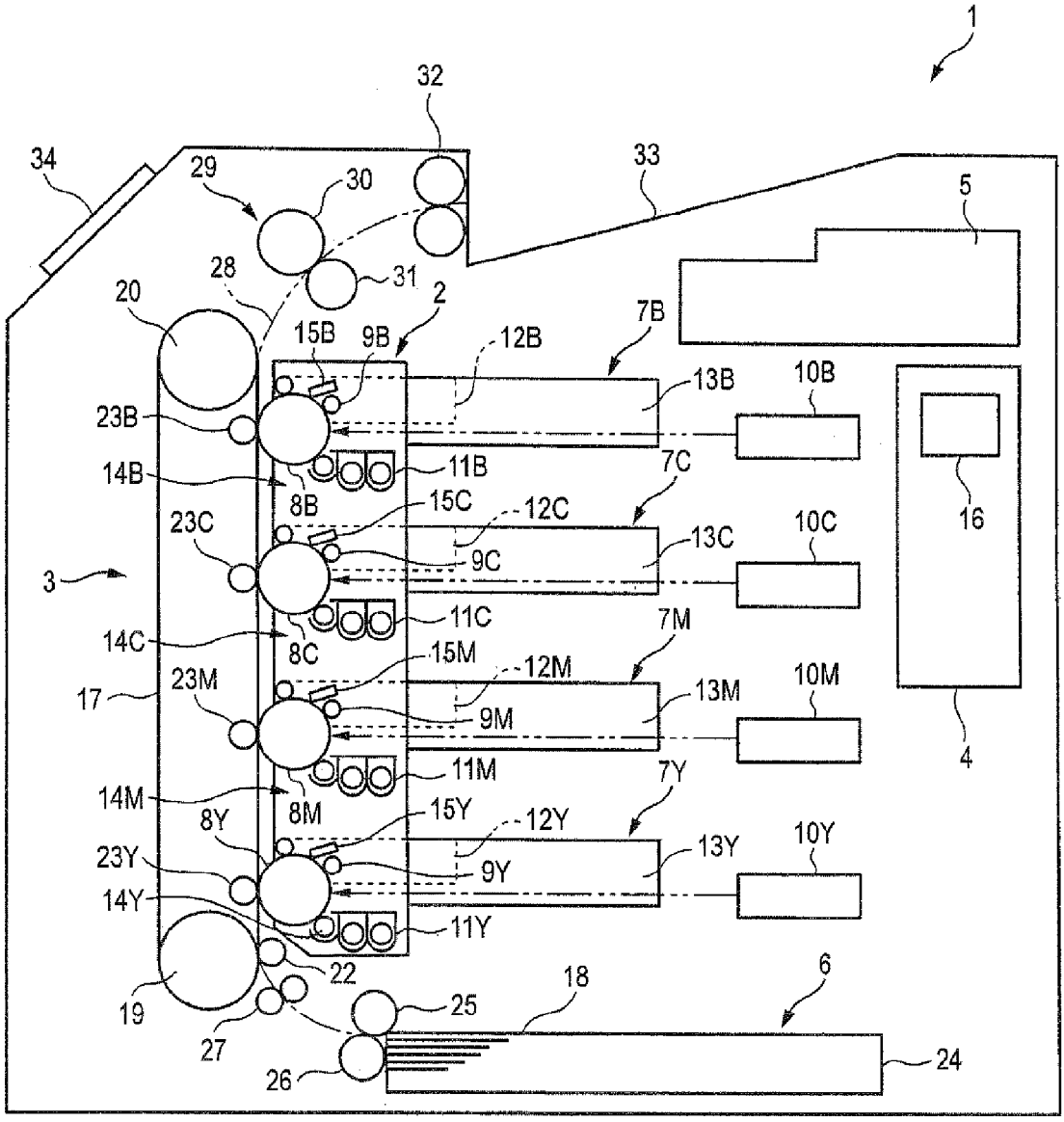
FIG. 2 is a configuration diagram showing a tandem type full-color printer as a direct transfer type image forming apparatus employing toner cartridges as developer storing containers, a method of assembling the toner cartridges, and a method of recycling the cartridges according to an exemplary embodiment of the invention.

FIG. 2 shows a tandem type full-color printer as a direct transfer type image forming apparatus employing toner cartridges as developer storing containers, a method of assembling the toner cartridges, and a method of recycling the cartridges according to an exemplary embodiment of the invention. The full-color printer is configured to perform a printing operation based on image data transmitted from, for example, a personal computer or scanner obviously, the image forming apparatus may be a copier or facsimile machine including a scanner or a combined machine configured to have the functions of the those apparatus.

In FIG. 2, reference numeral 1 represents a body of the tandem type full-color printer, and an image forming unit 2 is disposed substantially in the middle of the interior of the full-color printer body 1 so as to extend in the vertical direction. Inside the full-color printer body 1, a sheet conveying belt unit 3 is disposed on one side (left side in the illustrated example) of the image forming unit 2, the unit conveying a transfer material absorbed thereon on which toner images in a plurality of colors formed by the image forming unit 2 are transferred. A control unit 4 including a control circuit is disposed on the other side (right side in the illustrated example) of the image forming unit 2, and a power supply circuit unit 5 including a high voltage power supply circuit is disposed diagonally above the image forming unit 2. A sheet feeder 6 for feeding a transfer sheet 18 as the transfer material is disposed on the inner bottom of the full-color printer body 1.

The image forming unit 2 includes four image forming portions 7Y, 7M, 7C, and 7B, which are listed in the order of their closeness to the bottom of the unit, for forming toner images in yellow (Y), magenta (M), cyan (C), and black (B). The four image forming portions 7Y, 7M, 7C, and 7B are disposed in series in the vertical direction at predetermined intervals.

The four image forming portions 7Y, 7M, 7C, and 7B are similar in configuration except for the colors of images that they form. As shown in FIG. 2, each portion is generally comprised of a photosensitive drum 8 (8Y, 8M, 8C and 8B) rotating at a predetermined rotating speed in the direction of the arrow, a charge roll 9 (9Y, 9M, 9C and 9B) used for primary charging, i.e., for charging the surface of the photosensitive drum a uniformly, an ROS (Raster Output Scanner) 10 (10Y, 10M, 10C and 10B) for exposing an image in the associated color on the surface of the photosensitive drum 8 to form an electrostatic latent image, a developing device 11 (11Y, 11M, 11C and 11B) for developing the electrostatic latent image formed on the photosensitive drum 8 with toner in the associated color, a cleaning device 12 (12Y, 12M, 12C and 12B) for cleaning any residual toner left on the photosensitive drum 8 after a transfer, and a toner cartridge 13 (13Y, 13M, 13C and 13B) for supplying toner to the developing device 11.

As shown in FIG. 2, the developing device 11 supplies two-component or one-component developer stored therein to a developing roll 14 (14Y, 14M, 14C and 14B) while agitating the same, conveys the developer supplied to the developing roll 14 to a developing area facing the photosensitive drum 8 while regulating the thickness of the developer, and develops the electrostatic latent image formed on the surface of the photosensitive drum 8 with the toner which is in a predetermined color.

As shown in FIG. 2, the cleaning device 12 removes residual toner on the surface of the photosensitive drum 8 with a cleaning blade 15 (15Y, 15M, 15C and 15B), and the residual toner thus removed is conveyed into the cleaning device 12 and stored therein.

Further, the control unit 4 is disposed in the full-color printer body 1 as show in FIG. 2, and an image processor (IPS) 16 for performing, for example, a predetermined image process on image data is provided in the control unit 4. Image data in yellow (Y), magenta (M), cyan (C), and black (B) are sequentially output from the image processor 16 to the ROS 10, and four laser beams LB emitted from the ROS 10 according to the image data are scanned for exposure on respective photosensitive drums 8Y, 8M, 8C, and 8B to form electrostatic; latent images on them. The electrostatic latent images formed on the photosensitive drums 8Y, 8M, 8C, and 8B are developed into toner images in the respective colors, i.e., yellow (Y), magenta (M), cyan (C), and black (B).

As shown in FIG. 2, the sheet conveying belt unit 3 includes a sheet conveying belt 17 which is moved to circulate as an endless belt. The sheet conveying belt 17 is configured to convey a transfer sheet 18 electrostatically absorbed thereon as a transfer material to which toner images in yellow (Y), magenta (M), cyan (C), and black (B) formed by the image forming portions 7Y, 7M, 7C, and 7B are transferred.

The sheet conveying belt 17 is stretched under predetermined tension between a drive roil 19 and a driven roll 20 as stretching rolls disposed in the vertical direction as shown in FIG. 2, and the belt is configured to be moved for clockwise circulation at a predetermined speed by the drive roll 19 which is rotated by a drive motor (not shown).

For example, the distance between the drive roll 19 and the driven roll 20 is set substantially equal to the length of a transfer sheet of A4 size. However, the invention is not limited to such a distance, and it is obvious that the distance between the drive roll 19 and the driven roll 20 may be arbitrarily set. For example, a flexible synthetic resin film made of polyimide formed like an endless belt ray be used as the sheet conveying belt 17.

As shown in FIG. 2, an absorption roll 22 for electrostatically absorbing the transfer sheet 18 onto the surface of the sheet conveying belt 17 is disposed so as to contact the surface of the drive roll 19 through the sheet conveying belt 17. For example, the absorption roll 22 is formed by coating the surface of a metal core with conductive rubber in a manner similar to that used for the charge rolls 9 of the image forming portions 7Y, 7M, 7C, and 7B. A predetermined bias voltage for absorption is applied to the metal core. The absorption roll 22 electrostatically charges the transfer sheet 18 fed from the sheet feeder 6 to absorb the sheet onto the surface of the sheet conveying belt 17. It is not essential to provide the absorption roll 22.

Toner images in yellow (Y), magenta (M), cyan (C), and black (B) formed on the photosensitive drums 8Y, 8M, 8C, and 8B of the image forming portions 7Y, 7M, 7C, and 7B are transferred by transfer rolls 23Y, 23M, 23C, and 23B on a multi-pass basis in an overlapping relationship with each other onto the transfer sheet 18 which is absorbed and conveyed on the surface of the sheet conveying belt 17 as shown in FIG. 2. The transfer roll 23Y, 23M, 23C, and 23B are integrally mounted on the sheet conveying belt unit 3.

As shown in FIG. 2, the transfer sheets 18 are supplied from the sheet feeder 6 disposed on the bottom of the printer body 1. The sheet feeder 6 includes a sheet tray 24 containing the transfer sheets 15 which have a desired size and quality. The transfer sheets 18 having a desired size and quality are supplied from the sheet tray 24 by a feed roll 25 while being separated into each sheet by a handling roll 26 and are conveyed to an absorbing position on the sheet conveying belt 17 at predetermined timing.

Referring to the transfer sheets 18, various sheet members may be used including sheets in various sizes such as A4, A3, B5, and B4 sizes, sheets of various thicknesses such as plain paper and coated paper, and sheets of various quality such as OHP sheets.

The transfer sheet 18 having toner images in yellow (Y), magenta (M), cyan (C), and black (B) transferred on a multi-pass basis is separated from the sheet conveying belt 17 by the stiffness (rigidity) of the transfer sheet 18 itself. The sheet is thereafter conveyed to a fixing device 29 through a conveying path 28, and the toner image in each color is fixed on the transfer sheet 18 by heat and pressure from the fixing device 29. The sheet conveying belt 17 and the fixing device 29 are disposed close to each other, and the transfer sheet 18 separated from the sheet conveying belt 17 is conveyed to the fixing device 29 by a conveying force of the sheet conveying belt 17. Referring to the configuration of the fixing device 25, a heating roll 30 and a pressure belt 31 are rotated while being pressed against each other, and the transfer sheet 18 is passed through a nip portion formed between the heating roll 20 and the pressure belt 31 to perform a fixing process on the sheet using heat and pressure. Thereafter, the transfer sheet 18 having the toner image in each color fixed thereon is discharged by a discharge roll 32 onto a discharge tray 33 provided on the top of the full-color printer body 1 with the printed surface facing downward, and the printing operation is terminated.

The full-color printer can print not only full-color images but also images in desired colors including monochromatic images. A toner image is formed by all or some of the image forming portions 7Y, 7M, 7C, and 7B for yellow (Y), magenta (M), cyan (C), and black (B) depending on the color(s) of the image to be printed.

In FIG. 2, reference numeral 34 represents an operation panel having a display portion such as a liquid crystal panel mounted on a front side of the printer body 1. The operation panel 34 is configured to display states of the printer and to allow required operation to be performed.

A developer storing container according to the present embodiment includes a supplied developer-storing member forming a supplied developer-storing portion for storing supplied developer, a collected developer-storing member forming a collected developer-storing portion for storing collected developer, and a partition member which is sandwiched by the supplied developer-storing member and the collected developer-storing member by connecting the supplied developer-storing member and the collected developer-storing member and which separates the supplied developer-storing portion and collected developer-storing portion from each other.

In the present embodiment, as shown in FIG. 2, the developing devices 11Y, 11M, 11C, and 11B for yellow (Y), magenta (M), cyan (C), and black (B) include toner cartridges 13Y, 13M, 13C, and 13B as developer storing containers for supplying toner in yellow (Y), magenta (M), cyan (C), and black (B), respectively.

Figure 3:
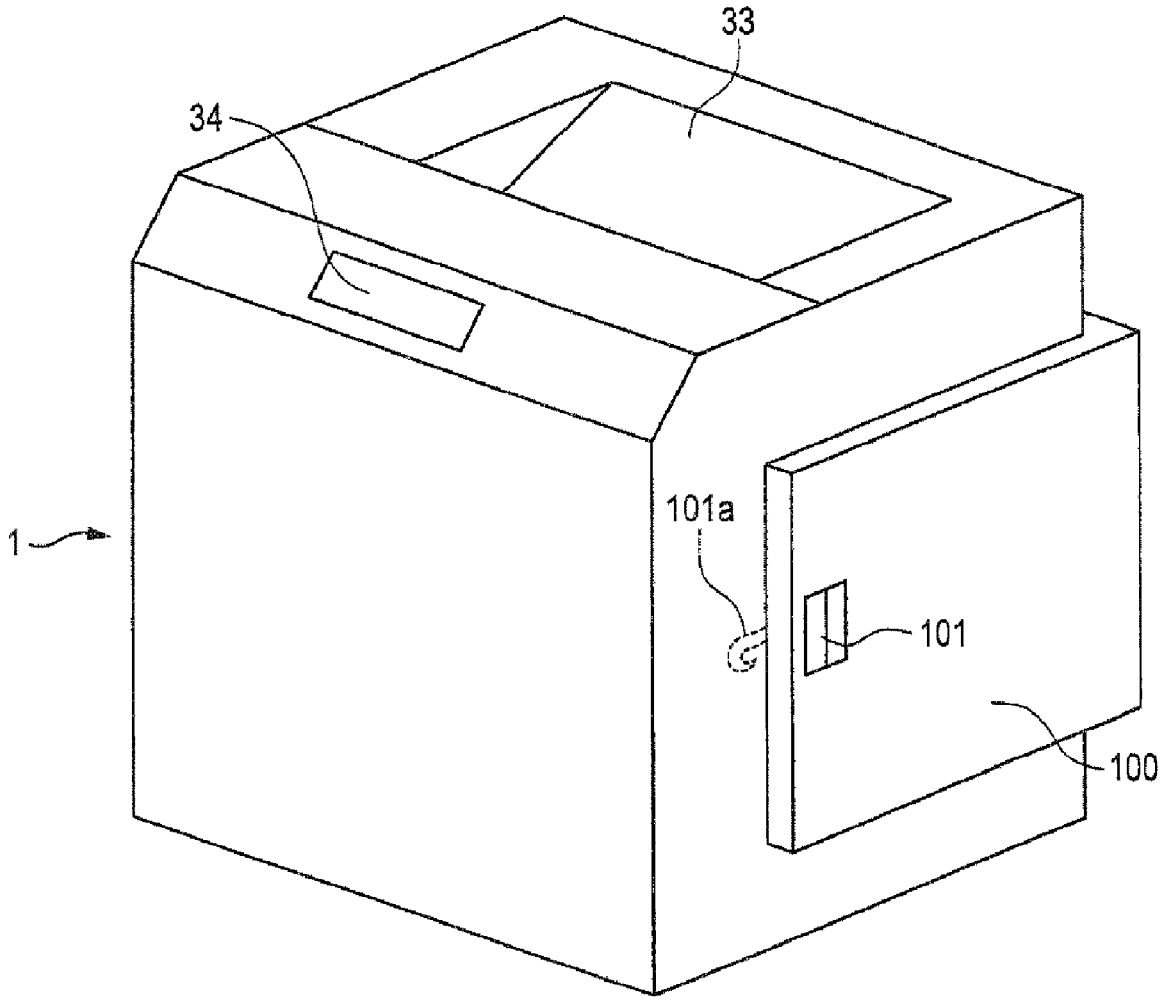
FIG. 3 is an external perspective view of the tandem type full-color printer.
Figure 4:
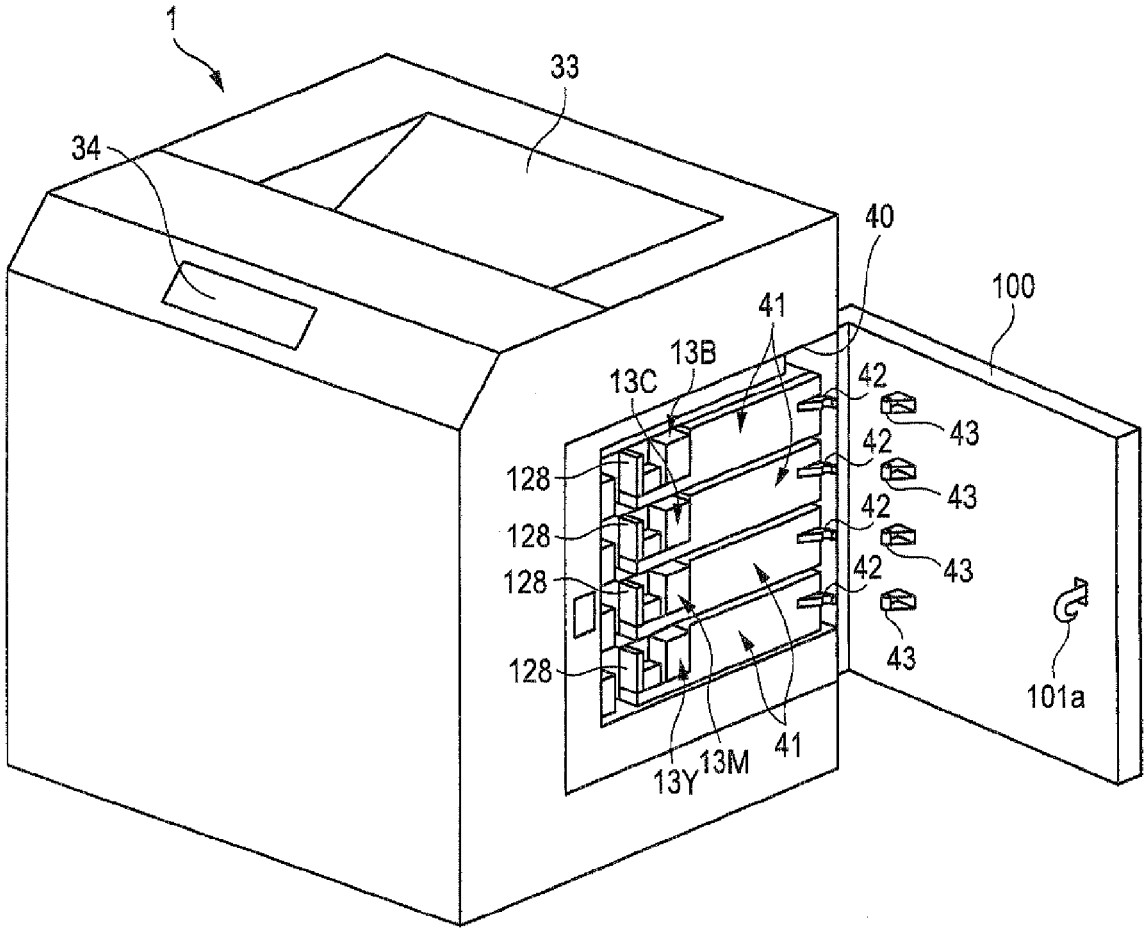
FIG. 4 is an external view showing the tandem type full-color printer with a cover of the same opened.

The toner cartridges 13Y, 13M, 13C, and 13B for yellow (Y), magenta (M), cyan (C), and black (B) are removably mounted by mounting them in cartridge holders 41 at an opening 40 which is exposed on a side of the printer body 1 as shown in FIG. 4 by opening an openable cover 100 provided on the side of the printer body 1, the openable cover 100 being opened by pulling a handle 101 provided thereon with a hand to unlock a hook 101*a* as shown in FIG. 3. The toner cartridges 13Y, 13M, 13C, and 13B are basically the same in configuration except for the colors of the toner stored in them.

The cartridge holders 41 are rotabaly mounted with ends of arms 42 protruding as shown in FIG. 4, and the ends of the arms 42 are configured to engage portions 43 to be engaged provided on the openable cover 100. The cartridge holders 41 rotate from the printer body 1 in conjunction with an operation of opening the openable cover 100 to a mounting/removing position.

The toner cartridges 13Y, 13M, 13C, and 13B are mounted in an operating position in the opening 40 of the printer body 11, and handle members 129 provided on the toner cartridges 13Y, 13M, 13C, and 13B are operated to secure the cartridges.

Figure 5:
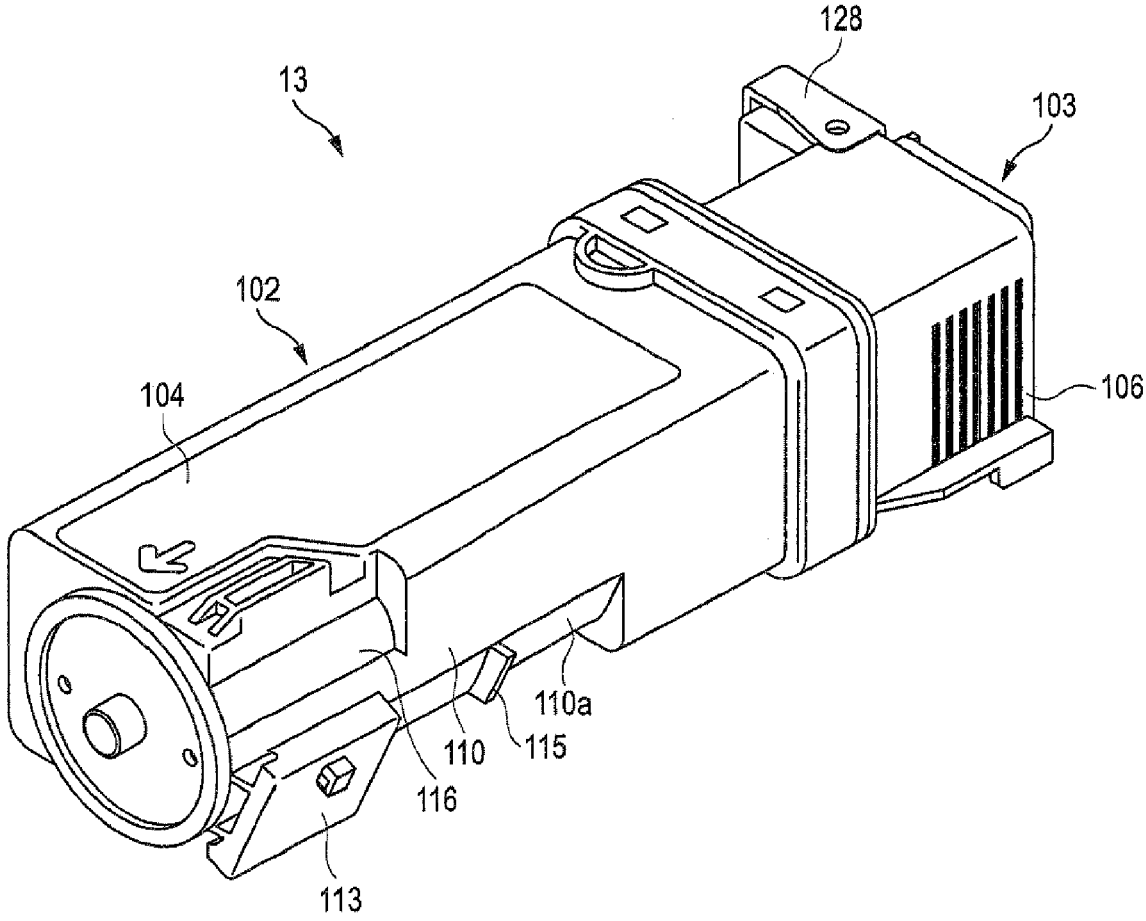
FIG. 5 is an external perspective view of a toner cartridge as a developer storing container according to an exemplary embodiment of the invention.
Figure 6:
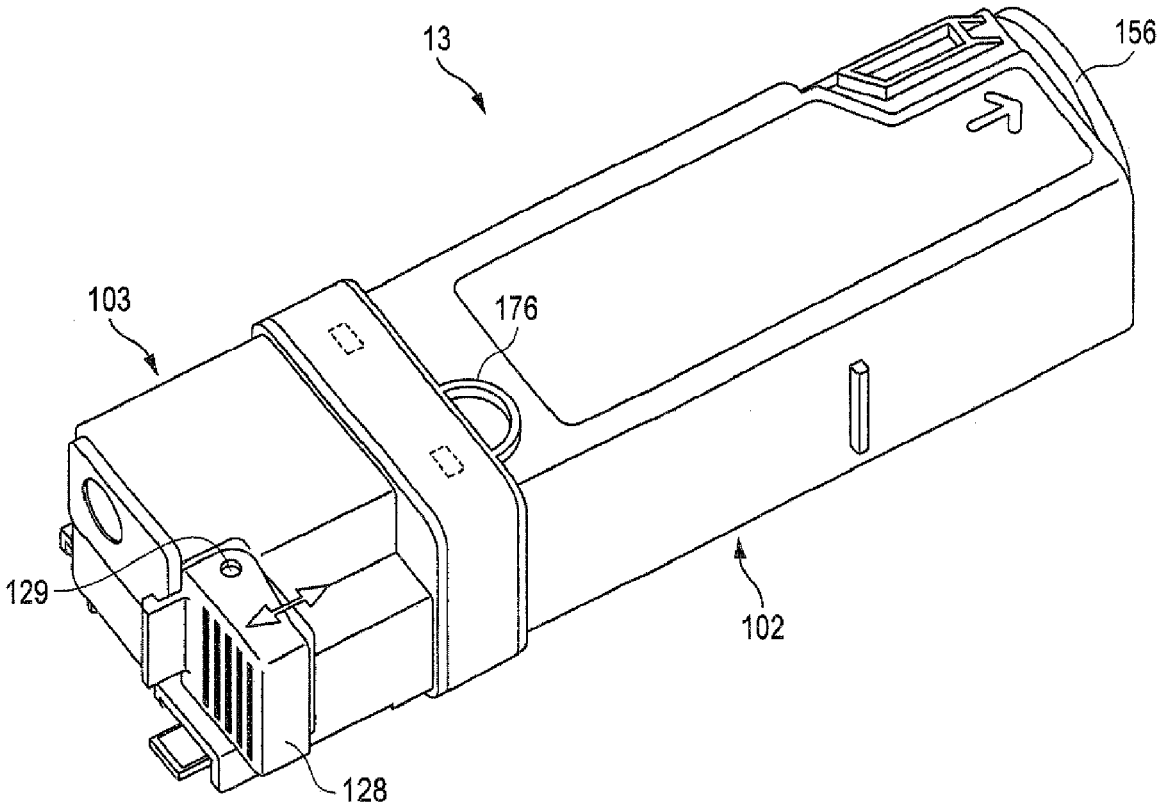
FIG. 6 is an external perspective view of the toner cartridge as a developer storing container according to an exemplary embodiment of the invention.

FIGS. 5 and 6 are external perspective views of a toner cartridge as a developer storing container according to the embodiment taken in different directions.

In FIGS. 5 and 6, reference numeral 13 represents the toner cartridge, and the toner cartridge 13 is configured as an elongated box which is substantially in the form of a rectangular parallelepiped. The toner cartridge 13 includes a supplied toner-storing container 104 having a supplied toner-storing portion 102 serving as a supplied developer-storing portion for storing supplied developer constituted by fresh toner or a combination of fresh toner and a carrier. The cartridge also includes a collected toner-storing container 106 which is connected to one longitudinal end of the supplied toner-storing container 104 and which has a collected toner-storing portion 103 serving as a collected developer-storing portion for storing collected toner removed by the cleaning device 12 or collected toner or collected developer collected from the developing device 11. In the present embodiment, collected toner removed by the cleaning device 12 is stored in the collected toner-storing portion 103. The volume of the supplied toner-storing portion 102 is set greater than that of the collected toner-storing portion 103. For example, the supplied toner-storing portion 102 is set to occupy about ¾ of the volume of the toner cartridge 13. Obviously, the supplied toner-storing portion 102 may have a greater or smaller volume.

Figure 7:
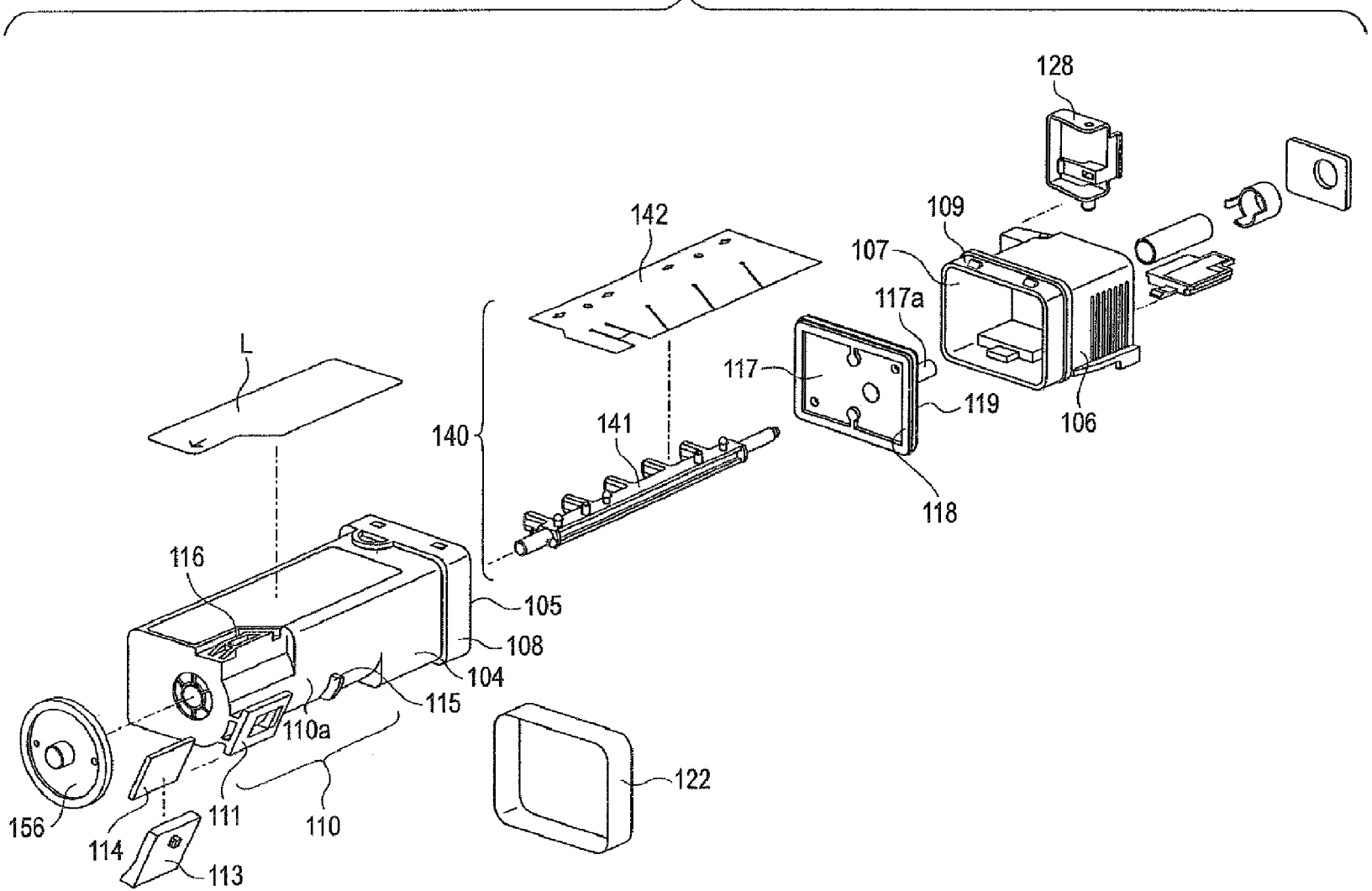
FIG. 7 is a perspective configuration view showing an exploded state of the toner cartridge as a developer storing container according to an exemplary embodiment of the invention.

As shown in FIG. 7, the supplied toner-storing portion 102 includes the supplied toner-storing container 104 that forms a part of the same. The supplied toner-storing container 104 is formed as an elongated box which is substantially in the form of a rectangular parallelepiped and which has an opening 105 that entirely occupies the end face of the container 104 on the side of the collected toner-storing portion 103. The collected toner-storing portion 103 includes the collected toner-storing container 106 that forms a part of the same. The collected toner-storing container 106 is formed as a substantially cubic box which has an opening 107 that entirely occupies the end face of the container 106 on the side of the supplied toner-storing portion 102. It is desirable to form the supplied toner-storing portion 102 and the collected toner-storing portion 106 in the substantially rectangular parallelepiped shape and the substantially cubic shape in that a great amount of fresh toner and collected toner can be stored in spite of limited spaces to accommodate the portions. However, the invention is not limited to the substantially rectangular parallelepiped shape and the substantially cubic shape, and it is obvious that other shapes such as cylindrical shapes and polygonal shapes may alternatively be employed.

Figure 1:
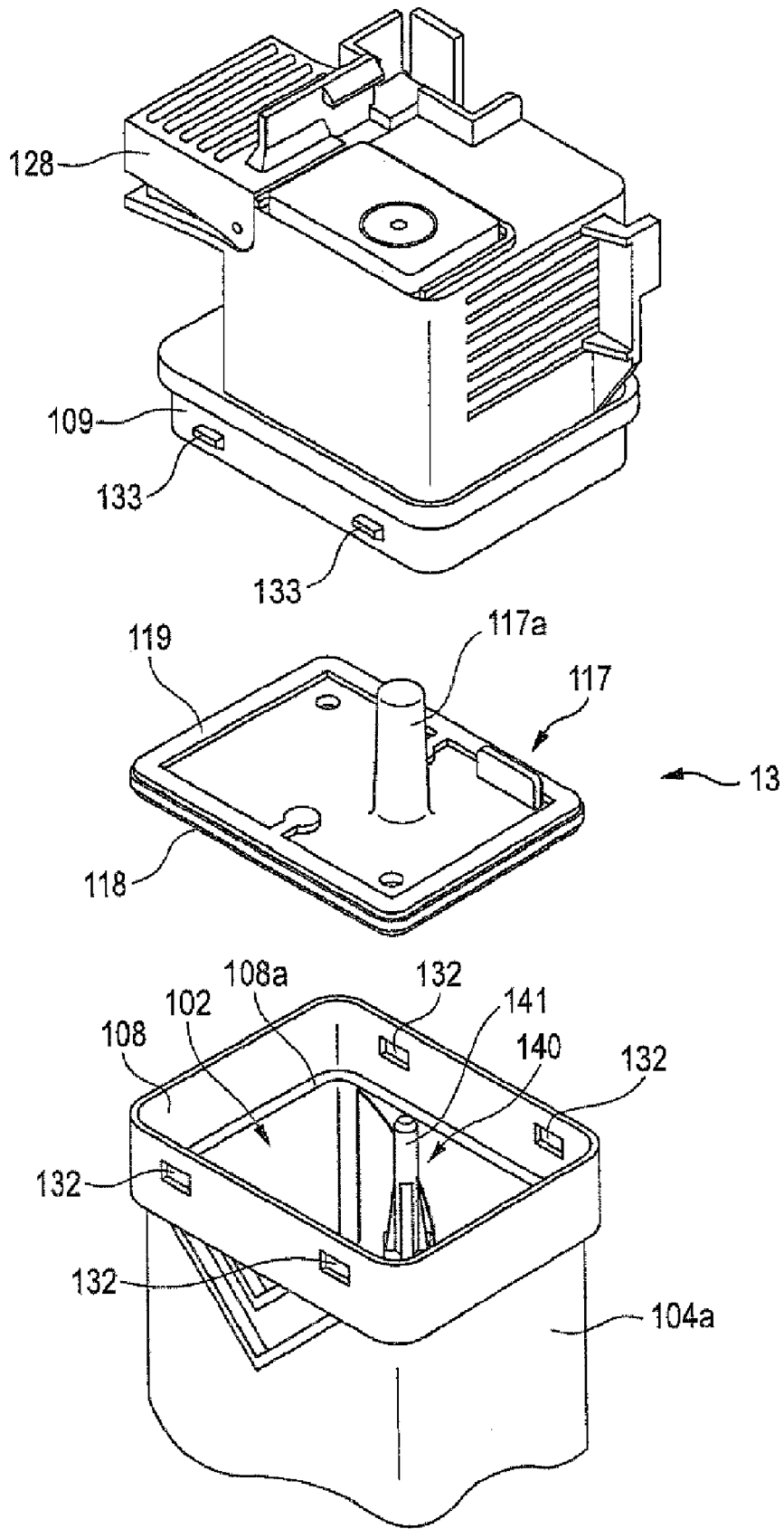
FIG. 1 is a perspective configuration view showing an exploded state of a toner cartridge as a developer storing container according to an exemplary embodiment of the invention.

Further, as shown in FIGS. 1 and 7, a connecting portion 108 is provided at the end of the supplied toner-storing container 104 where the opening 105 is located, and a connecting portion 109 to be fitted to an inner circumference of the connecting portion 108 of the supplied toner-storing container 104 is provided at the end of the collected toner-storing container 106 where the opening 107 is located.

In the neighborhood of the opening of the supplied toner-storing container 104, as shown in FIG. 1, the connecting portion 108, which has a rectangular shape a size larger than a step portion 108*a*, is formed around the outer circumference of an end portion 104*a* of the supplied toner-storing portion 102 of the supplied toner-storing container 104 formed with a substantially rectangular sectional shape, the step portion 108*a* intervening between the connecting portion and the end portion. The connecting portion 109 of the collected toner-storing container 106 is formed in a rectangular shape smaller than the connecting portion 108 of the supplied toner-storing container 104 such that it will be fitted into the connecting portion 108 of the supplied toner-storing container 104. The inner circumference of the connecting portion 108 of the supplied toner-storing container 104 has a length substantially equal to the length of the outer circumference of the connecting portion 109 of the collected toner-storing container 106.

Figure 8:
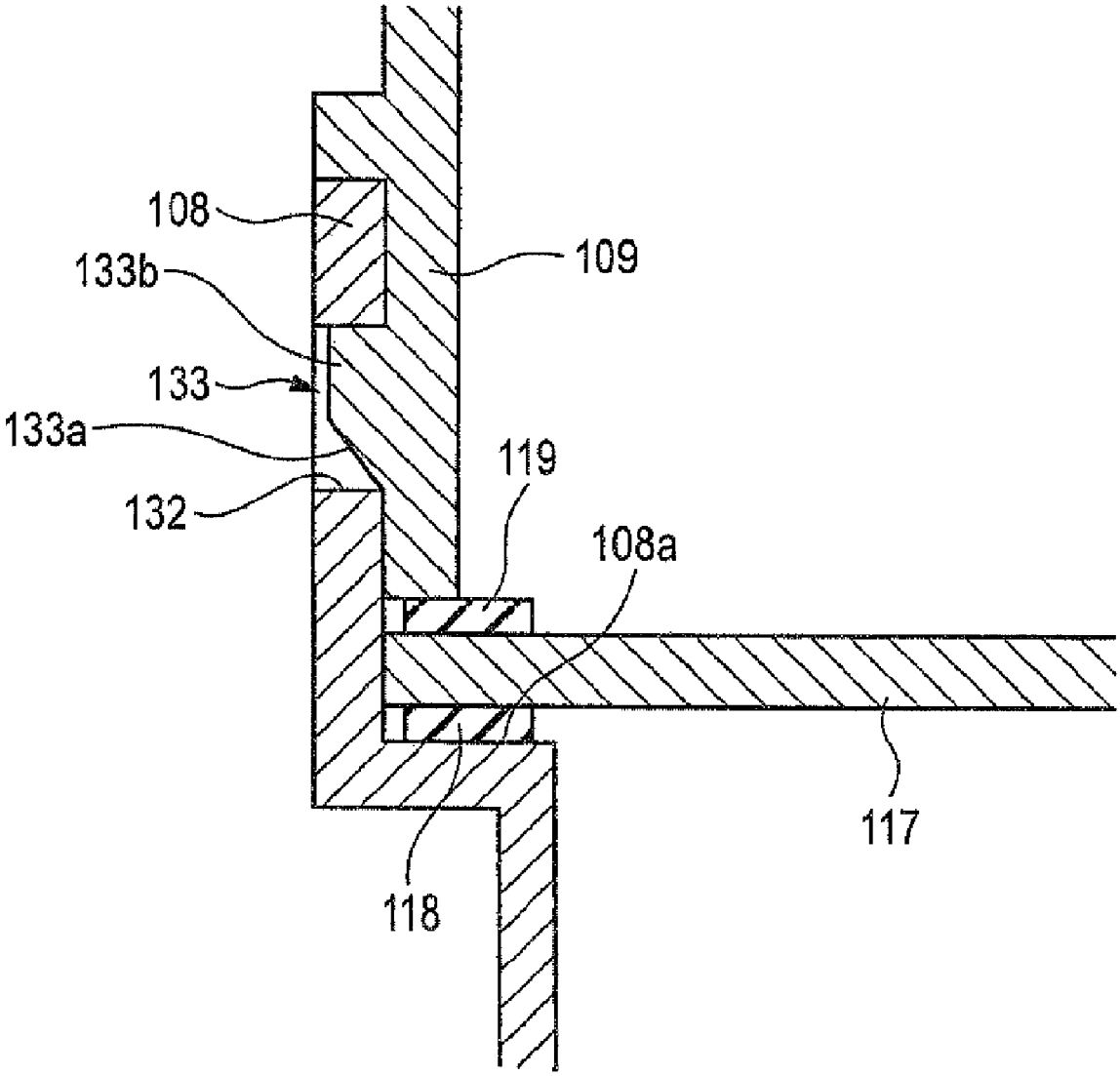
FIG. 8 is a sectional view of major parts of the toner cartridge as a developer storing container according to an exemplary embodiment of the invention.

As shown in FIG. 1, the connecting portion 108 of the supplied toner-storing container 104 has two small rectangular connection holes 132 provided at a predetermined interval on each of top and bottom surfaces thereof, the connecting holes being snap-fitted into engagement with the connecting portion 109 of the collected toner-storing container 106 to connect the containers with each other. The connecting portion 109 of the collected toner-storing container 106 has two small rectangular protrusions 133 provided on each of top and bottom surfaces thereof in association with the connection holes 132, the protrusions being snap-fitted into engagement with the connection holes provided at the connecting portion 108 of the supplied toner-storing container 104 no connect the containers with each other. As shown in FIG. 8, a protrusion 133 is formed with an inclined surface 133*a* and is formed in a trapezoidal shape having a predetermined height at a rear end 133*b* of the protrusion. The connecting portion 109 of the collected toner-storing container 106 is pushed into the connecting portion 108 of the supplied toner-storing container 104, and the protrusions 133 on the connection portion 109 of the collected toner-storing container are thereby engaged with the connection holes 132 on the connecting portion 108 of the supplied toner-storing container 104, which allows the containers to be snap-fitted and connected with each other.

The snap-fit connection between the supplied toner-storing container 104 and the collected toner-storing container 106 can be released by inserting the tip of a screw driver into the connection holes 132 on the connecting portion 108 of the supplied toner-storing container 104 and giving a twist to the screw driver, which allows the containers to be easily disassembled.

Figure 9A:
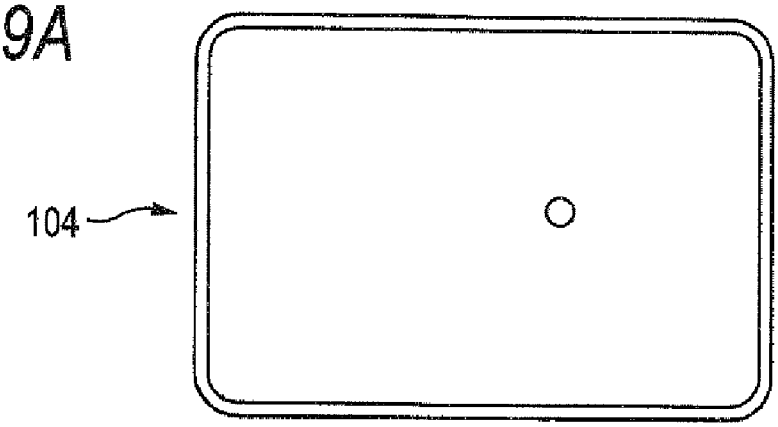
FIGS. 9A, 9B, and 9C are sectional views of the toner cartridge as a developer storing container according to an exemplary embodiment of the invention.
Figure 9B:
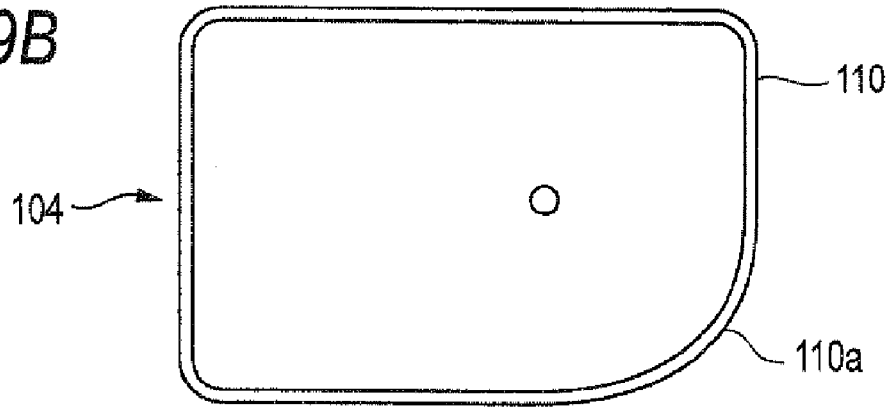
Figure 9C:
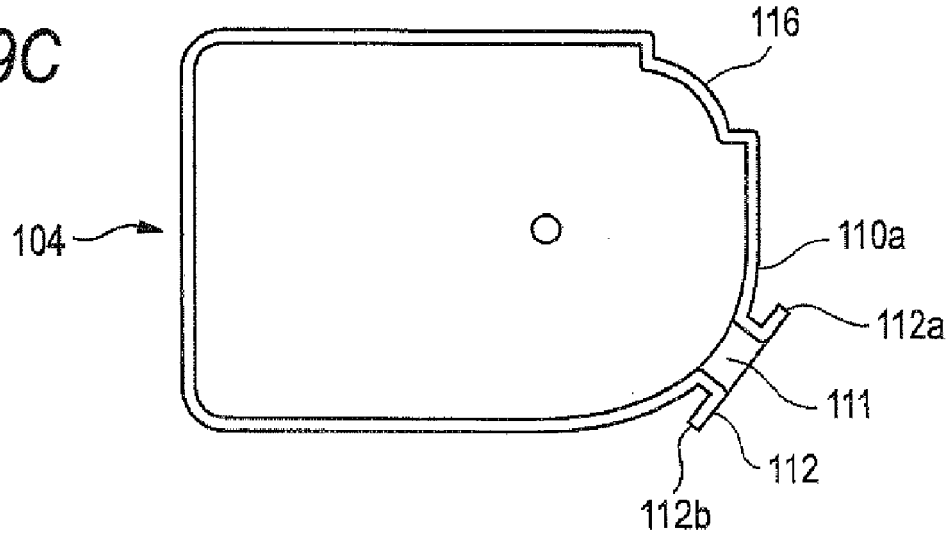

As shown in FIG. 9A, the supplied toner-storing container 104 is formed to have a substantially rectangular sectional shape in the neighborhood of the opening 105. Referring to a portion 110 of the container extending in the longitudinal direction thereof from the end opposite to the opening 105 to occupy about ⅔ of the container length, a side surface 110*a* at the bottom right of the portion is formed in an arcuate shape as shown in FIG. 9B. At a longitudinal end of the side surface 110*a* formed in an arcuate shape, as shown in FIG. 9C, a toner supply port 111 for supplying toner to the developing device 11 is provided. A square frame portion 112 is provided integrally with the toner supply port 111 so as to protrude outward from the port. Upper and lower edges 112*a* and 112*b* of the frame portion 112 constitute guide members for guiding a shutter 113 which will be described later. As shown in FIG. 5, a shutter 113 for closing and disclosing the toner supply port 111 is mounted on the upper and lower edges 112*a* and 112*b* of the frame portion 112 constituting guide members such that the shutter can be slid in the horizontal direction. A seal member 114 is disposed and bonded onto an inner surface of the shutter 113 as shown in FIG. 7, A driving piece 115 for moving the toner cartridge protrudes from the side surface 111*a* at the right bottom of the supplied toner-storing container 104 as shown in FIG. 5. In the portion 110 of the container 104 extending in the longitudinal direction thereof from the end opposite to the opening 107*r* as shown in FIGS. 5 and 9C, a recess 116 is provided on a side surface at the top right part of the portion, the recess extending to occupy about ⅓ of the container length.

Figure 10:
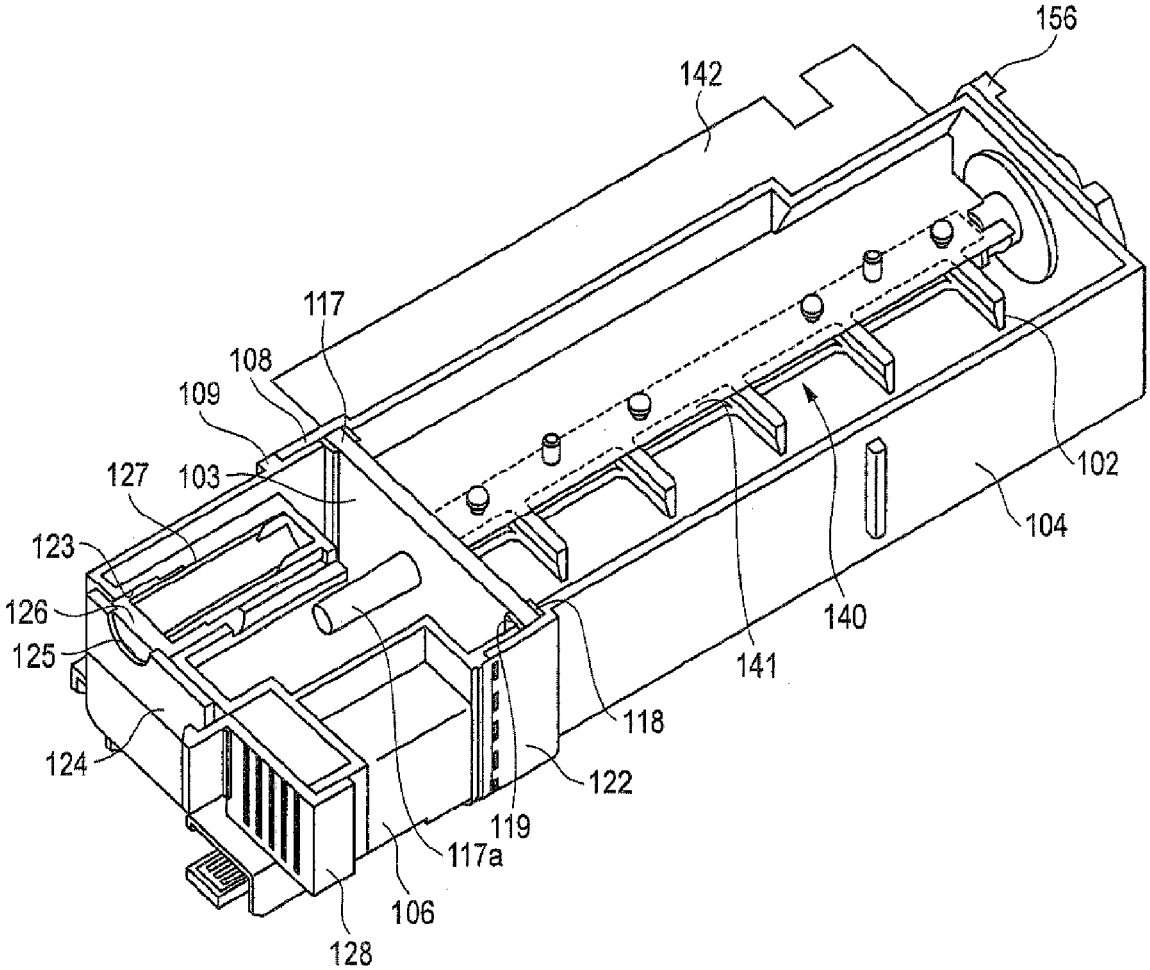
FIG. 10 is a perspective configuration view showing a section of the toner cartridge as a developer storing container according to an exemplary embodiment of the invention.

The supplied toner-storing container 104 and the collected toner-storing container 106 are connected to each other by fitting the connecting portion 108 provided around the opening 105 of the supplied toner-storing container 104 with the connecting portion 109 provided around the opening 107 of the collected toner-storing container 106 as shown in FIGS. 7 and 10. As shown in FIGS. 7 and 8, the containers are separated from each other with a partition member 117 and sealing members 118 and 119 serving as leakage preventing members provided integrally with the partition member on both sides thereof. As a result, the supplied toner-storing portion 102 for storing supplied toner is formed inside the supplied toner-storing container 104, and the collected toner-storing portion 103 for storing collected toner is formed inside the collected toner-storing container 106.

As shown in FIGS. 1 and 7, the partition member 117 is constituted by a planar and rectangular plate made of a synthetic resin. The seal members 118 and 119 in the form of planar and rectangular bands are formed along outer circumferential edges of surfaces of the partition member 117 facing the supplied toner-storing portion 102 and the collected toner-storing portion 103, respectively, the seal members being formed integrally with the partition member 117. In order to provide high sealing properties, the seal members 118 and 119 are formed by an elastic body such as silicon rubber. However, when operability in inserting the partition member 117 into the connecting portion 108 of the supplied toner-storing container 104 is considered, the seal members 118 and 119 must be prevented from directly contacting an inner wall of the connecting portion 108 of the supplied toner-storing container 104 to avoid generation of sliding resistance. For this reason, the length of the outer circumference of the partition member 117 is made smaller than the length of the inner circumference of the connecting portion 108 such that the member will not interfere with the connecting portion 108. Referring to the seal members provided in the form of hands extending along the outer circumferential edge of the partition member 117 without covering up to the outer circumferential end of the same as shown in FIGS. 1 and 8, although the seal member is preferably provided on both sides of the partition member 117, the seal member may alternatively be provided on one side only.

As shown in FIG. 1, the partition member 117 is formed with a hole constituting a cylindrical bearing portion 117*a* as an integral part thereof for pivotally supporting an agitator shaft 141 of an agitator 140 serving as an agitating member which will be described later. The cylindrical bearing portion 117*a* is formed such that a closed end of the same protrudes toward the collected toner-storing container 106, and the closed end is formed to protrude toward the collected toner-storing portion 103 beyond the end of the connecting portion 108 of the supplied toner-storing container 104. Further, the bearing portion 117*a* of the partition member 117 also serves as a handle to allow the member to be gripped by a robot hand of an automatic assembling machine when the partition member 117 is mounted in the connecting portion 108 of the supplied toner-storing container 104 by the automatic assembling machine to assemble the toner cartridge 13. Such a handle may be provided separately from the bearing portion 117*a*.

The partition member 117 is partially or entirely made transparent as occasion demands to allow the agitator shaft 141 of the agitator 140 located inside the supplied toner-storing container 104 to be observed from outside when the partition member 117 is mounted in the connecting portion 108 of the supplied toner-storing container 104. The member may be semi-transparent as long as the agitator shaft 141 can be observed when it is mounted.

The outer circumferences of the connecting portions 108 and 109 of the supplied toner-storing container 104 and the collected toner-storing container 106 are covered by a tape 122 as shown in FIG. 7 to form the toner cartridge 13 such that the supplied toner-storing container 104 and the collected toner-storing container 106 will not be separated from each other by mistake. The toner cartridge 13 can be easily disassembled by removing the tape 122, which allows the cartridge to be easily recycled.

As shown in FIG. 10, a circular collected toner introduction port 123 is formed on an end face of the collected toner-storing container 106, and a duct seal 124 constituted by sponge for preventing the leakage of collected toner is secured by means of bonding or the like on the outer surface of the collected toner-storing container 106 where the collected toner introduction port 123 is provided. The duct seal 124 has a circular opening 125 having a diameter a size smaller than that of the collected toner introduction port 123. A collected toner shutter 126 formed in a cylindrical shape is disposed in the collected toner 123 of the collected toner-storing container 106 such that it can be slid in the directions of protruding and retracting the same. The collected toner shutter 126 is urged by a shutter spring 127 in the direction of protruding the same. A tip 126*a* of the collected toner shutter 126 is fitted into the opening 125 of the duct seal 124 while the collected toner shutter 126 is being urged in the direction of protruding the same, which allows the collected toner introduction port 123 to be closed.

As will be described later, when the toner cartridge 13 is mounted in a predetermined position in the printer body 1, a waste toner transport path 190 having a cylindrical shape provided at the printer body 1 is inserted into the collected toner introduction port 123. By pushing the collected toner shutter 126 against the urging force of the shutter spring 127, collected toner can be introduced from the waste toner transport path 190 in the printer body 1 into the collected toner-storing portion 103 in the toner cartridge 13.

Figure 11:
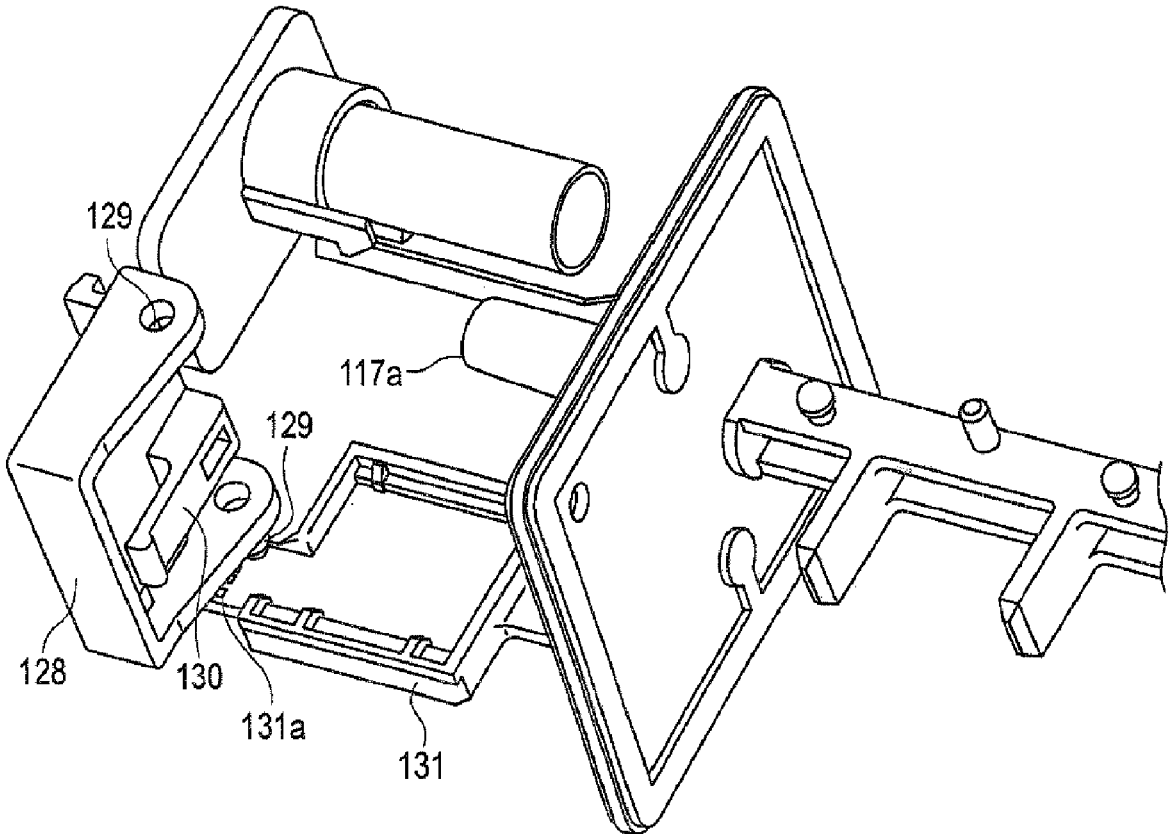
FIG. 11 is a perspective view of major parts of the toner cartridge as a developer storing container according to an exemplary embodiment of the invention.

As shown in FIGS. 10 and 11, a handle member 128 for mounting and securing the toner cartridge 13 in the predetermined position is mounted on the collected toner-storing container 106 such that it can be rotated about a fulcrum 129. A spring portion 130 for urging the handle member 128 clockwise is integrally provided on an inner surface of the handle member 128.

As shown in FIGS. 10 and 11, a RAM 131 is detachably mounted on the bottom of the collected toner-storing container 106, the RAM serving as storage means for storing data such as the color of the toner stored in the toner cartridge 13, the serial number of the same, and the history of use of the toner cartridge 13. The RAM 131 is connected to the printer body 1 through an electrical contact 131*a* when the toner cartridge 13 is mounted in the predetermined position in the printer body 1.

An agitator 140 as an agitation/transportation member for transporting the supplied toner stored in the supplied toner-storing portion 102 while agitating the same is disposed in the supplied toner-storing portion 102 of the toner cartridge 13 as shown in FIG. 10. The agitator 140 is generally comprised of an agitator shaft 141 as a rotary shaft member and an agitator film 142 as a rotating blade member. For simplicity, FIG. 10 shows the agitator film 142 in a stretched state.

Figure 13A:
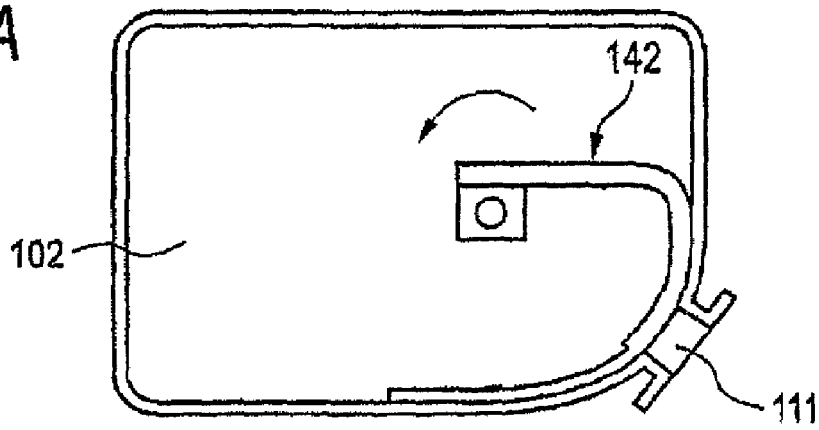
FIGS. 13A, 13B, and 13C are sectional views of the toner cartridge as a developer storing container according to an exemplary embodiment of the invention.
Figure 13B:
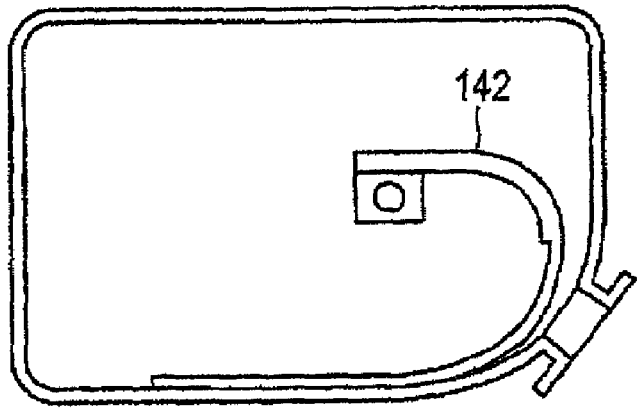
Figure 13C:
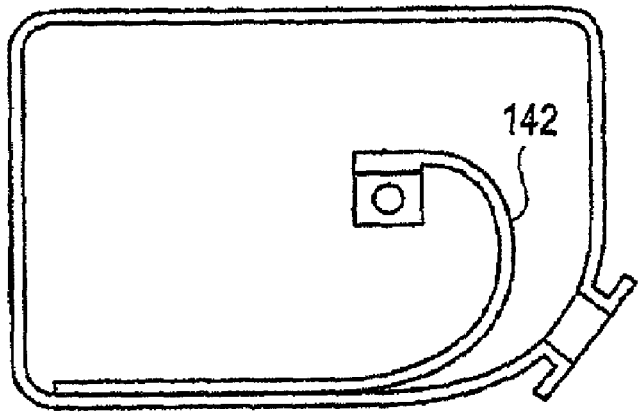
Figure 14:
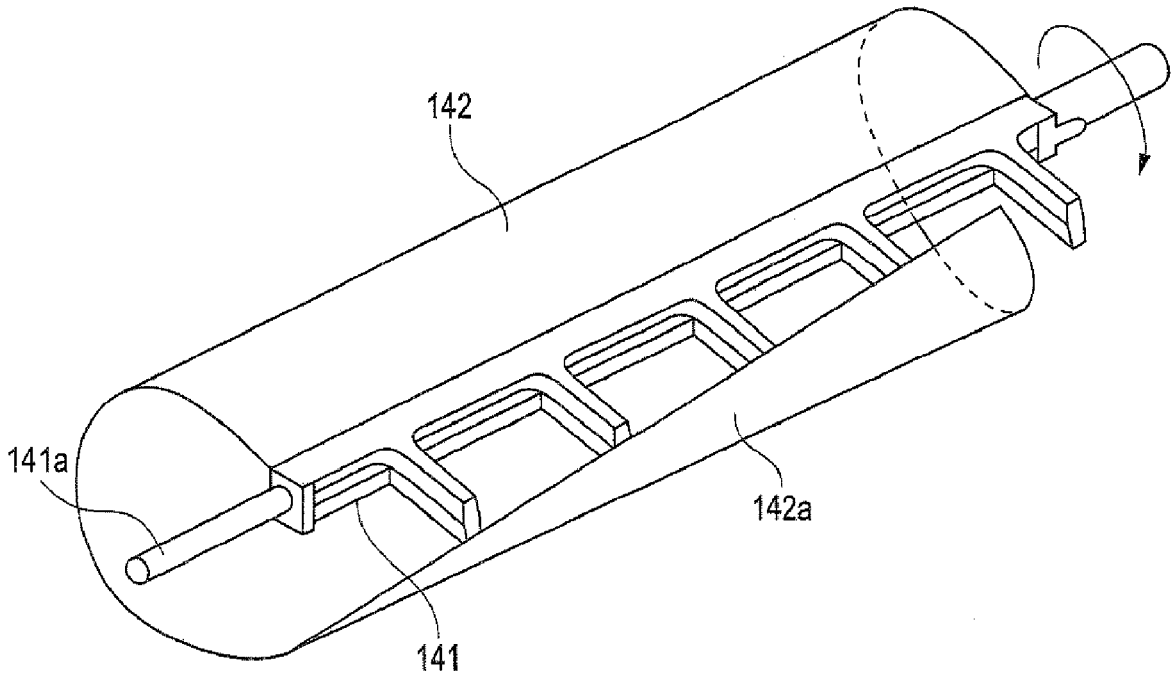
FIG. 14 is a perspective view of the agitator at the toner cartridge as a developer storing container according to an exemplary embodiment of the invention.

As shown in FIGS. 13 and 14, the agitator 140 is rotated in a spirally deformed state of the same as a result of deflection of the agitator film 142 caused by contact of an end of the film with an inner surface of the supplied toner-storing portion 102. The agitator is configured to gradually supply the toner stored in the supplied toner-storing portion 102 through the toner supply port 111 provided at an end of the supplied toner-storing portion 102 while agitating the supplied toner.

A tip part 141*a* of the agitator shaft 141 is elongated as shown in FIG. 14, and the tip portion 141*a* is inserted in a bearing hole 117*b* at the bearing portion 117*a* and rotatably supported in the same as shown in FIG. 1.

Figure 12:
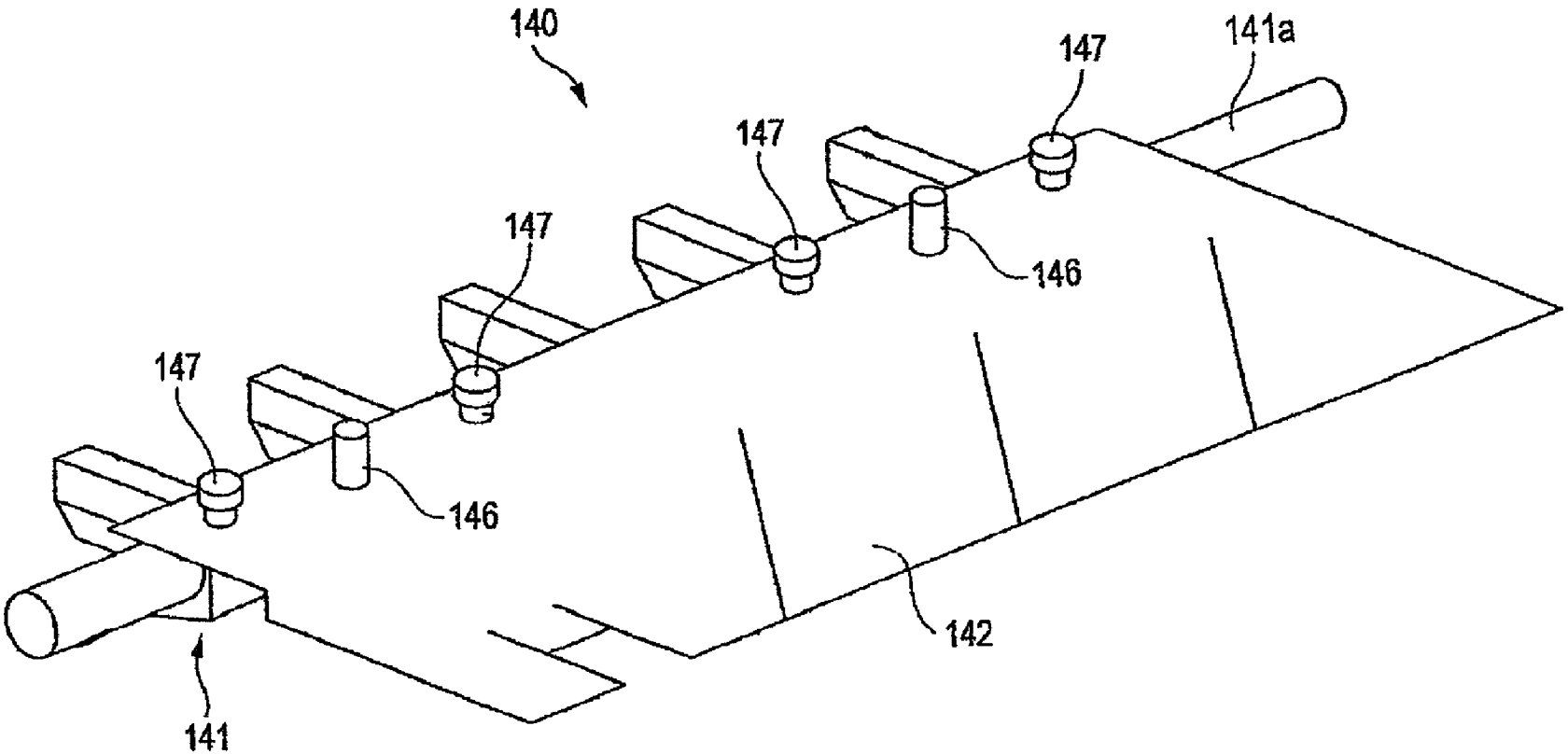
FIG. 12 is a perspective view of an agitator of the toner cartridge as a developer storing container according to an exemplary embodiment of the invention.
Figure 15:
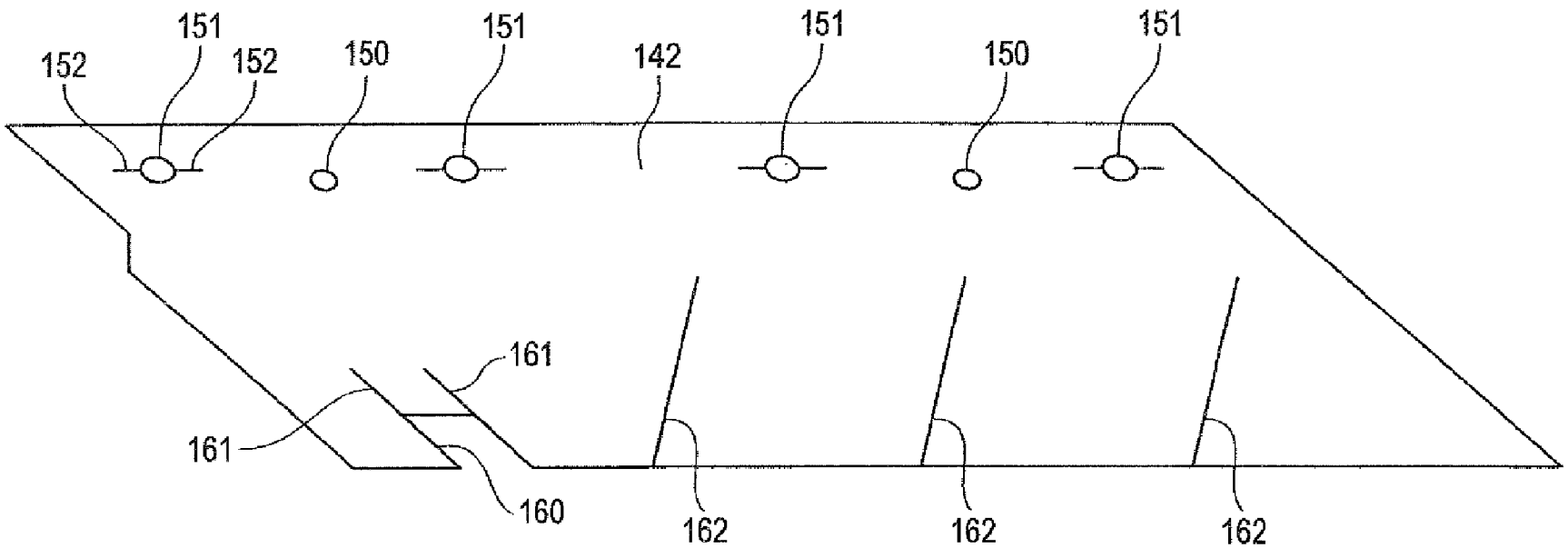
FIG. 15 is a perspective view of an agitator film.

As shown in FIGS. 12 and 15, the agitator film 142 has insertion holes 150 and 151 and cuts 152 for inserting protrusions 146 and 147 on the agitator shaft 141 to mount the film. The film is also formed with slits 162, a recess 160, and cuts 161 for adjusting the amount of toner transported.

Figure 16:
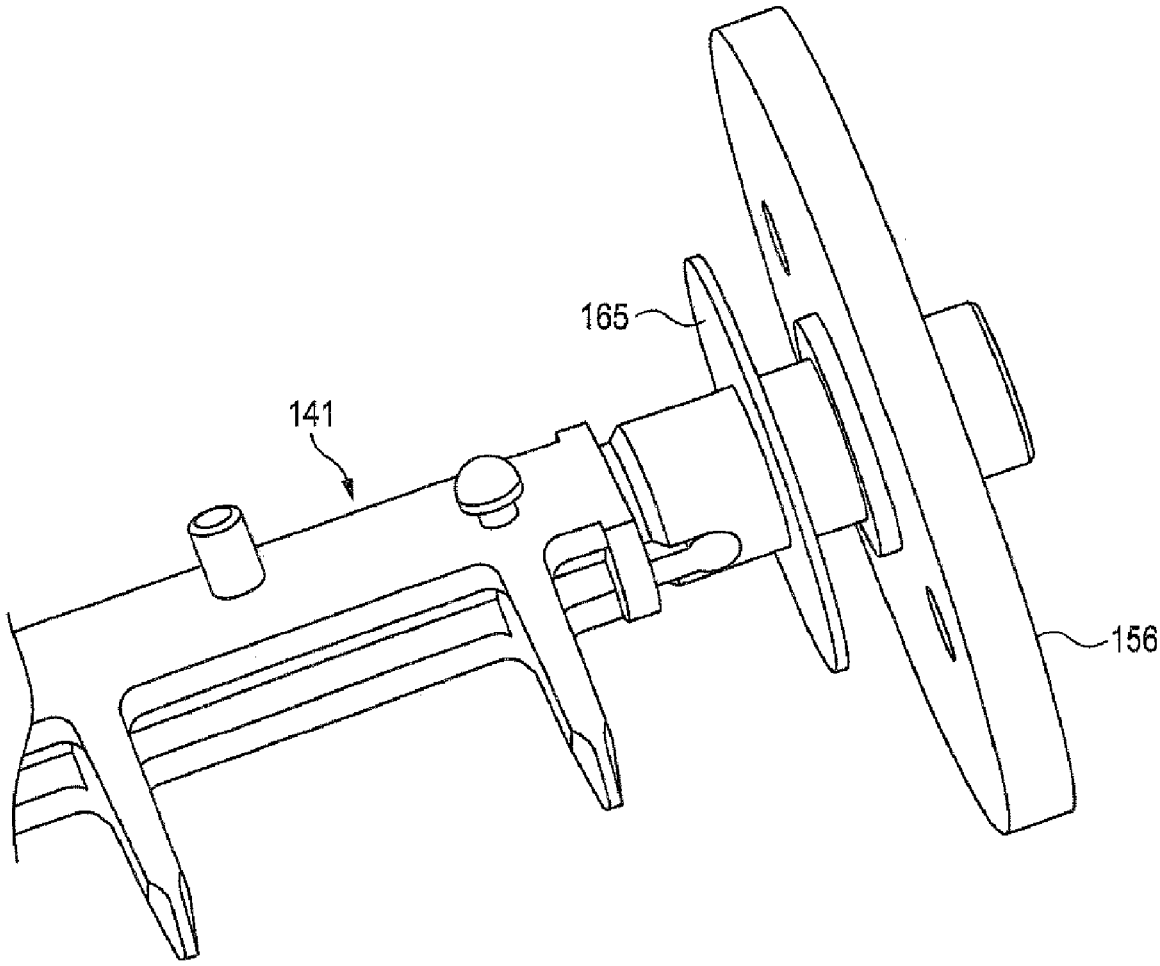
FIG. 16 is a perspective view of a driving portion of the agitator.

Further, as shown in FIG. 16, a drive gear 156 for rotating the agitator shaft 141 is mounted at a base end part of the agitator shaft 141 with a seal member 165 interposed. As shown in FIG. 7, the drive gear 156 is disposed outside the supplied toner-staring container 104 and at the end of the container opposite to the collected toner-storing container 106. The drive gear 156 has a great diameter, and a gear part of the same protrudes outward from the recess 116 (see FIG. 9C) provided at a corner of the supplied toner-storing container 104.

The agitator 140 is basically configured such that the agitator shaft 141 is rotated slowly at a predetermined angle at predetermined timing in order to control the amount of toner supplied from the toner supply port 111 adequately.

Figure 17:
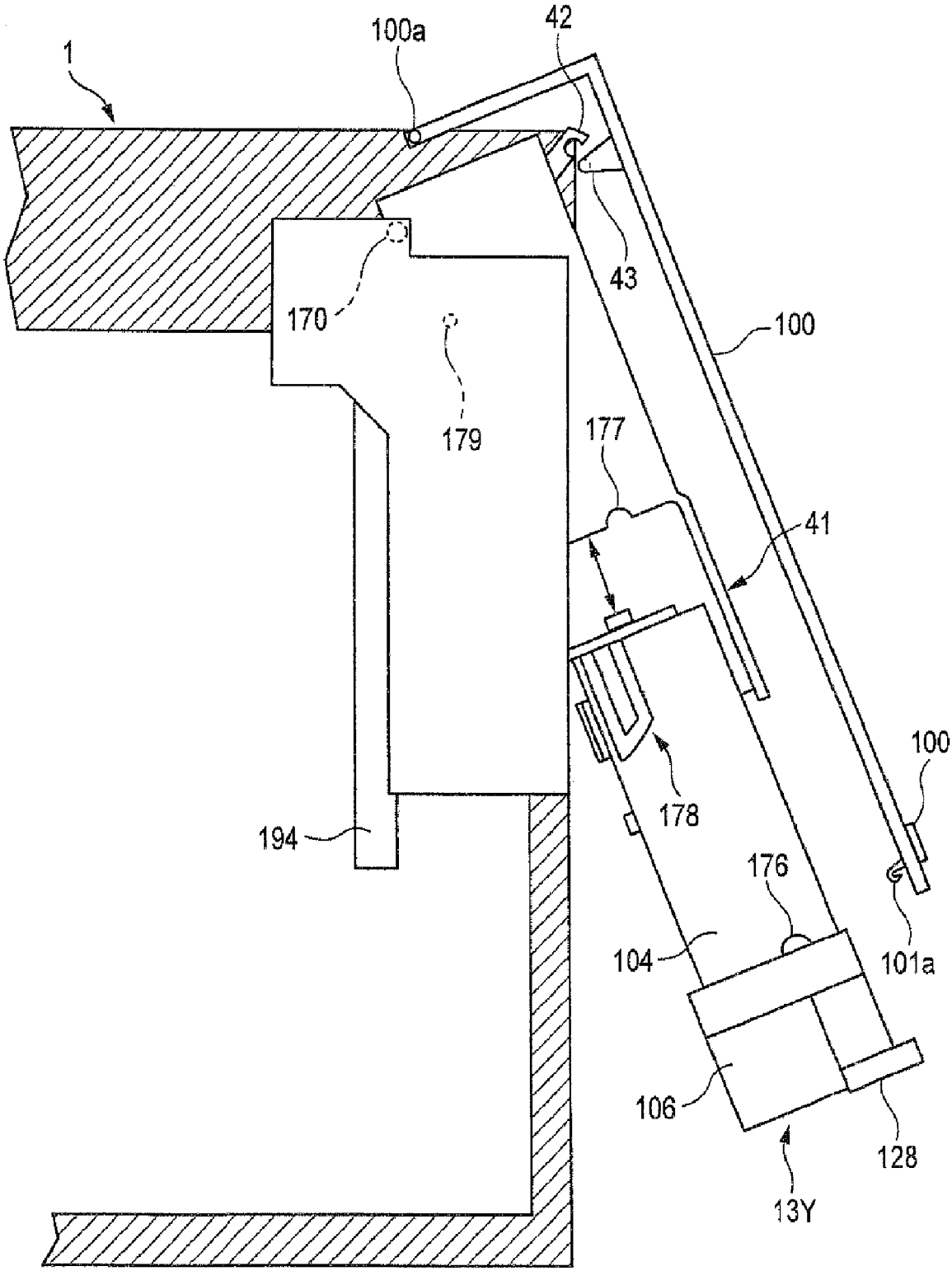
FIG. 17 is a configuration view showing a state of mounting of the toner cartridge.
Figure 18:
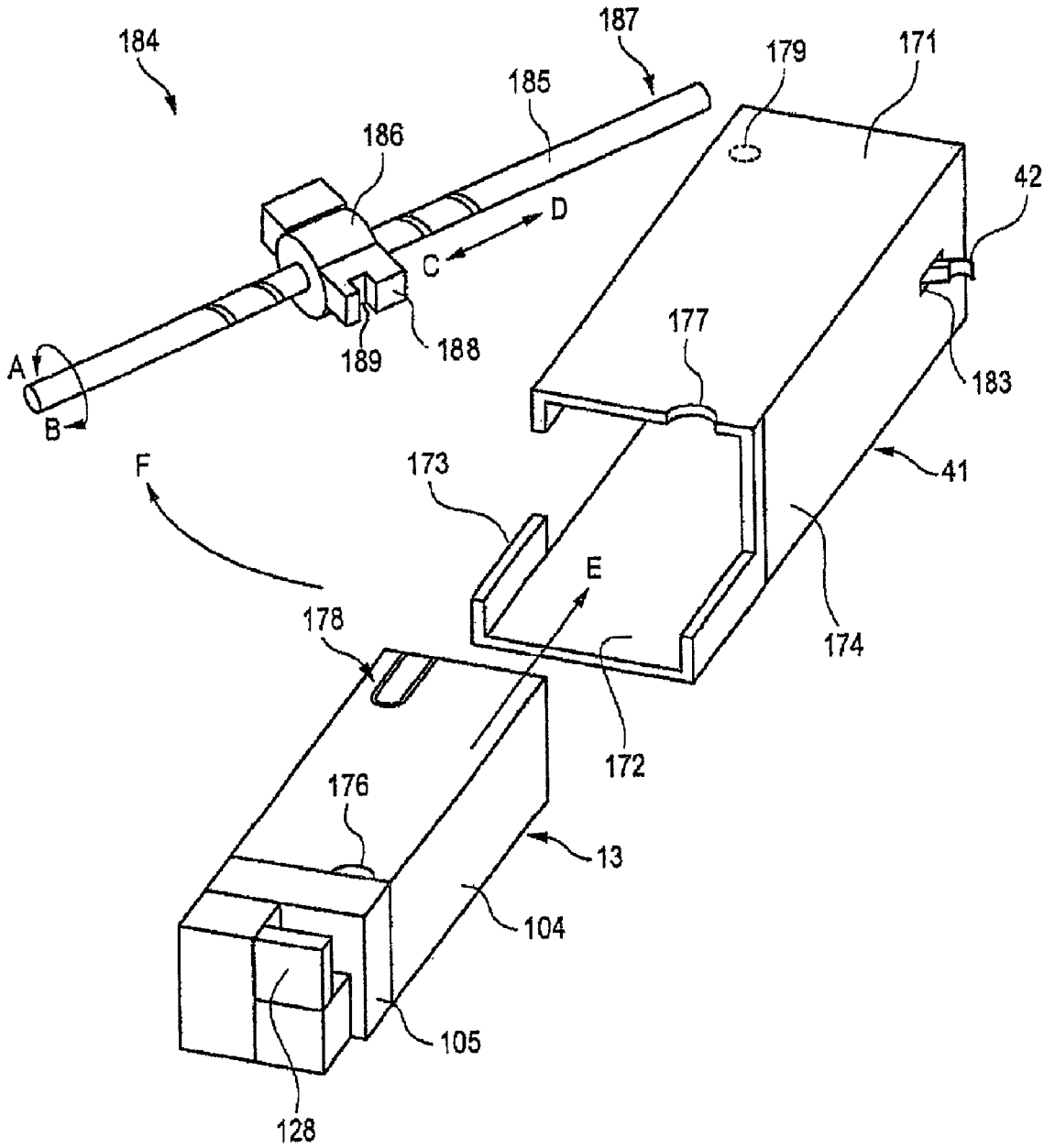
FIG. 18 is a perspective configuration view showing a state of mounting of the toner cartridge.

As shown in FIGS. 17 and 18, the toner cartridge 13 having the above-described configuration is mounted in a cartridge holder 41 at the printer body 1 with the openable cover 100 of the printer body 1 opened. The cartridge holder 41 is provided in the printer body 1 such that it can be rotated about a fulcrum 170 as shown in FIG. 17. As shown in FIG. 18, the cartridge holder 41 is in the form of a substantially rectangular parallelepiped which is open at an end thereof and which has a ceiling wall 171, a bottom wall 172, left and right sidewalls 173 and 174, and a further wall 175 constituting a top surface, a bottom surface, left and right side surfaces, and an end face on the further side of the toner cartridge 13, respectively.

As shown in FIG. 17, a substantially semi-circular recess 177 to be engaged with a substantially semi-circular protrusion 176 provided on the top and of the toner cartridge 13 is provided at the end of the ceiling wall 171 where the opening of the cartridge holder 41 is located. The protrusion 176 and the recess 177 are not limited to the substantially semi-circular shapes, and it is obvious that other shapes such as a planar V-like shape may alternatively be used.

As shown in FIG. 18, a columnar protrusion 179 to be engaged with an engaging portion 179 for regulating provided on the top end face of the toner cartridge 13 is provided on an inner surface of the ceiling wall 171 of the cartridge holder 41.

Figure 19:
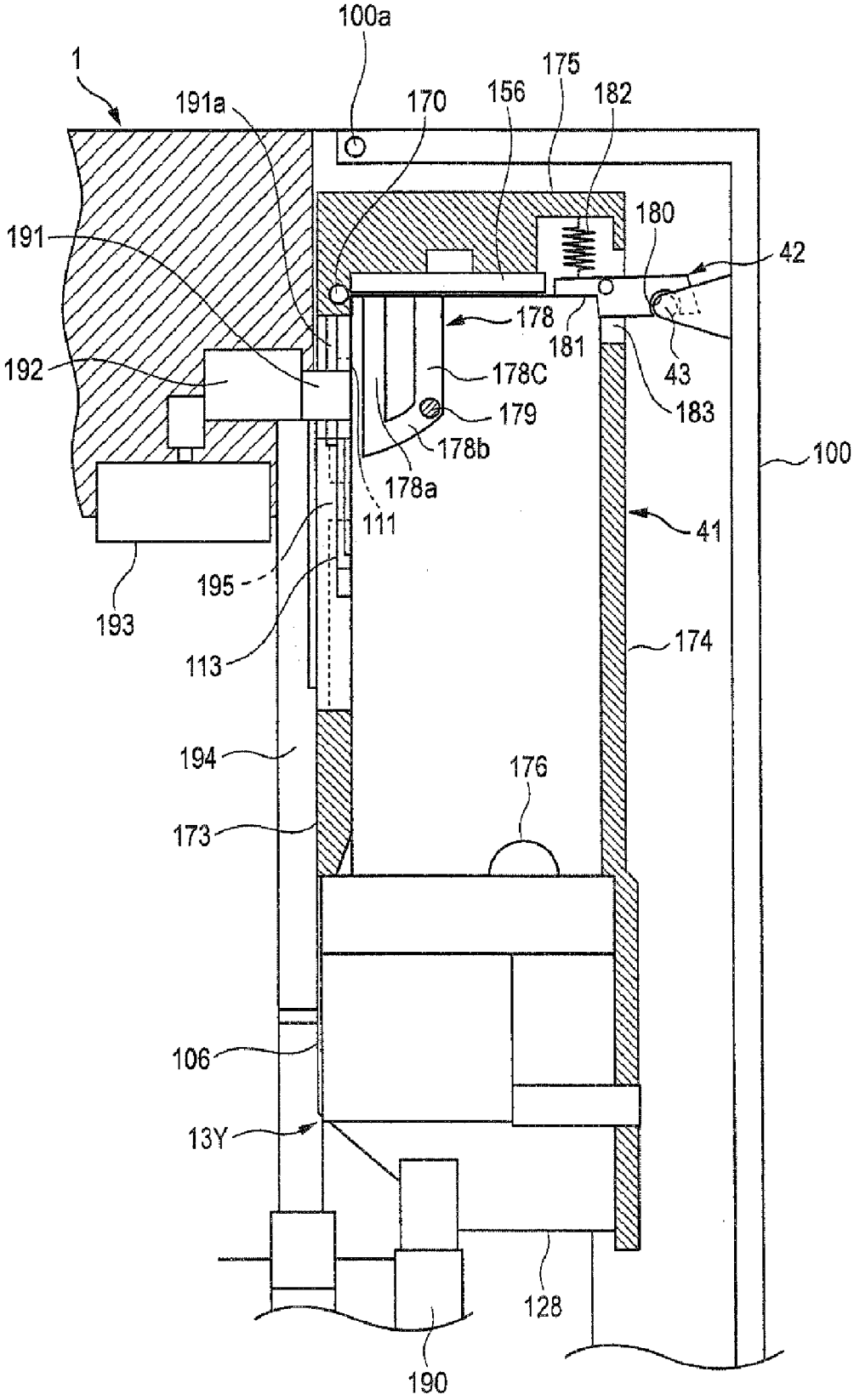
FIG. 19 is a sectional configuration view showing a state of mounting of the toner cartridge.
Figure 20:
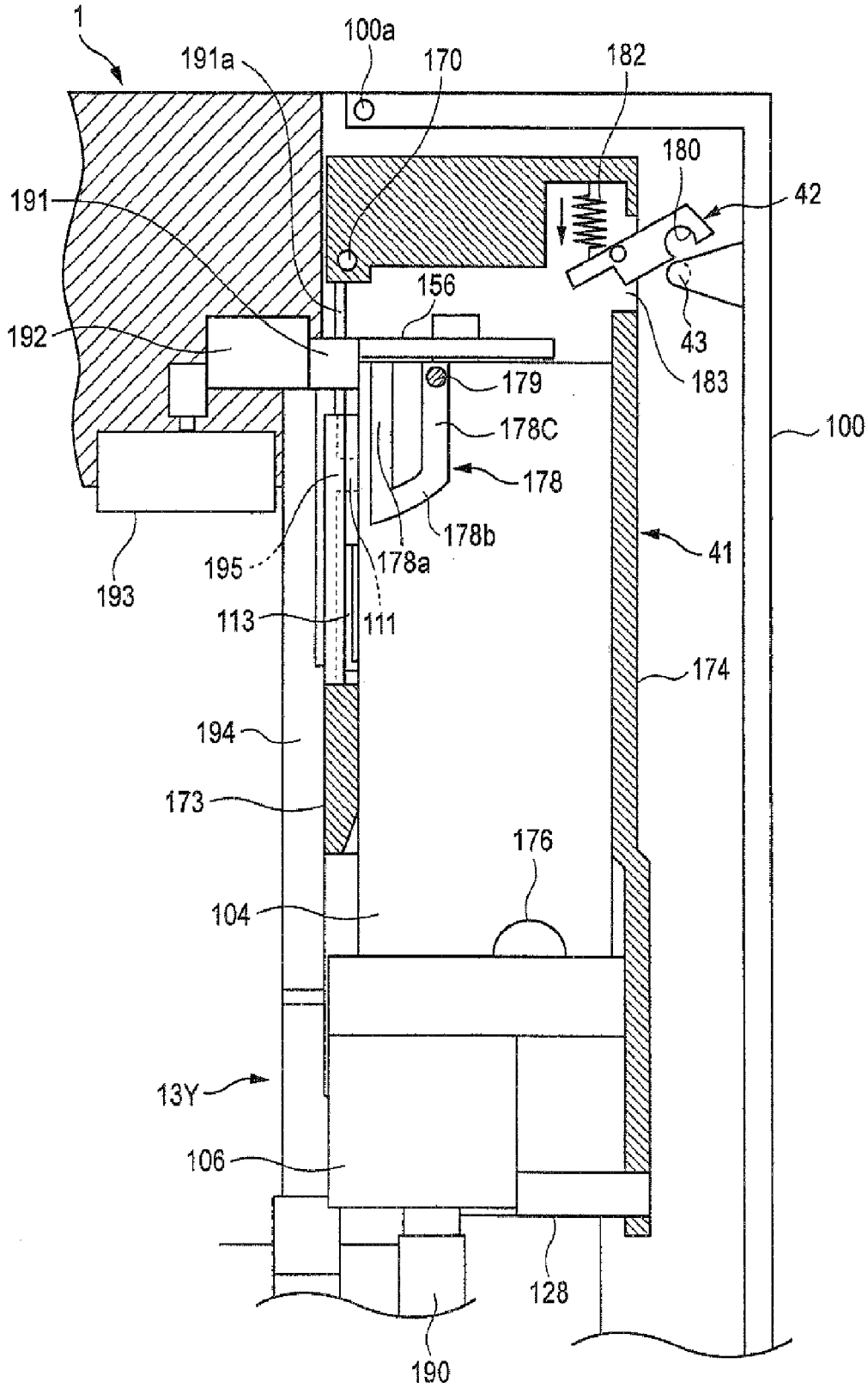
FIG. 20 is a sectional configuration view showing a state of mounting of the toner cartridge.

The toner cartridge 13 is mounted by pushing it deep into the cartridge holder 41 as shown in FIGS. 17 and 19. Thereafter, the handle member 128 is gripped with a hand to slide the cartridge downward in FIG. 19, and the handle member 129 is then anchored by an anchoring portion, which is not shown, provided in the printer body 1 to stop the cartridge as shown in FIG. 20. In this state, the shutter member 113 of the toner cartridge 13 is opened to establish communication between the toner supply port 111 of the toner cartridge 13 and a toner introduction port 195 at the printer body 1. At the same time, an end of the collected toner transport path 190 provided at the printer body 1 is connected to the toner collection port 125 of the toner cartridge 13, and the drive gear 156 of the toner cartridge 13 engages a gear 191 provided at the printer body 1. Reference numeral 100*a* in FIG. 17 represents a fulcrum of the cover 100.

An alternative configuration may be employed, in which the toner cartridge 13 is stopped with the further end of the cartridge abutting on one end of a lever 42 and in which the cartridge holder 41 is rotated in conjunction with the operation of closing the openable cover 100 to be mounted in a predetermined position in the printer body 1, as shown in FIG. 1-9.

When the toner cartridge 13 is pushed to a predetermined position in the cartridge holder 41, as shown in FIG. 19, a groove 180 provided at an end of the lever 42 engages a portion 43 to be engaged provided on the openable cover 100. The lever 42 is mounted on the cartridge holder 41 to be rotatable about a fulcrum 181 in a state in which it is urged by a compression spring 182 in the direction of urging the same counterclockwise. The lever is configured such that the end of the same protrudes outward from an opening 183 provided on the cartridge holder 41.

As shown in FIG. 19, the engaging portion 178 for regulation provided on the top end face of the toner cartridge 13 is engaged with the protrusion 179 provided on the inner surface of the ceiling wall 171 of the cartridge holder 41 to regulate the movement of the toner cartridge 13.

When the toner cartridge 13 is pushed into the cartridge holder 41, the protrusion 179 on the cartridge holder 41 is first located in a groove 178*a* of the engaging portion 178 for regulation. When the toner cartridge 13 is thereafter pushed to a predetermined position in the cartridge holder 41 to be mounted in the printer body 1, the cartridge holder 41 rotates clockwise. In this state, since the protrusion 179 on the cartridge holder 41 moves along a groove 178*b* provided at the engaging portion 178 for regulation, the holder is restrained from movement in the direction of causing the toner cartridge 13 to protrude.

When the toner cartridge 13 is finally pushed to a predetermined position in the cartridge holder 41, as shown in FIG. 19, the protrusion 179 on the cartridge holder 41 is located in a groove 178*c* at the engaging portion 178 for regulation, which allows the toner cartridge 13 to move in the protruding direction.

As shown in FIG. 18, the toner cartridge 13 is configured such that it is moved inside the cartridge holder 41 by a cartridge moving mechanism 184. The cartridge moving mechanism 184 includes a ball screw 187 constituted by a threaded shaft 185 rotatably disposed in the printer body 1 and a nut portion 186 engaged with the threaded shaft 185. A slit 189 on a driving portion 188 provided at the nut portion 186 is engaged with the driving piece 115 (see FIG. 5) on the toner cartridge 13 to rotate the threaded shaft 185 in a direction A or direction B, whereby the nut portion 186 is moved in a direction C or direction D. Thus, the toner cartridge 13 can be moved.

When the toner cartridge 13 is moved by the cartridge moving mechanism 184, as shown in FIG. 20, the waste toner transport path 190 having a cylindrical shape provided at the printer body 1 is connected to the waste toner collection port 123 provided on one end of the toner cartridge.

Further, when the toner cartridge 13 is moved to the position shown in FIG. 20, the driving gear 156 provided on the toner cartridge 13 engages a driving force transmitting gear 191 provided at the printer body 1. Thus, a rotary driving force of a driving motor 193 provided at the printer body 1 is transmitted to the driving gear 156 of the toner cartridge 13 through an intermediate gear 192.

Figure 21:
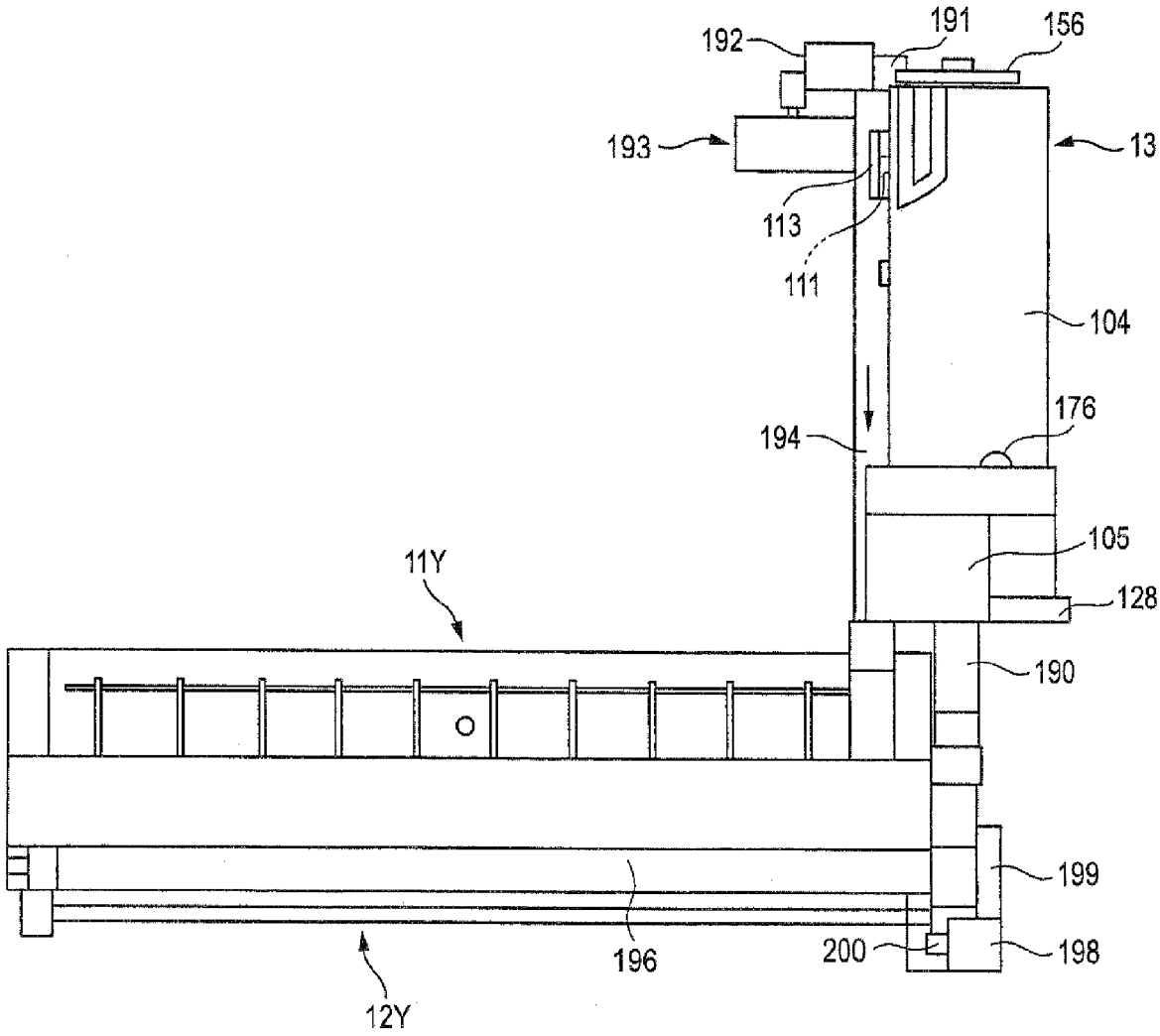
FIG. 21 is a configuration view showing a supply path for supplying toner from the toner cartridge to a developing device.

When the toner cartridge 13 moves to the position shown in FIG. 20, the shutter member 113 closing the toner supply port 111 provided on a side of the toner cartridge 13 is opened to put the port in communication with a toner introduction port 195 of a toner transport member 194 provided at the printer body 1. Thus, the toner to be supplied stored in the supplied toner-storing portion 105 of the toner cartridge 13 is supplied to the developing device 11 at the printer body 1 as shown in FIG. 21.

Figure 22:
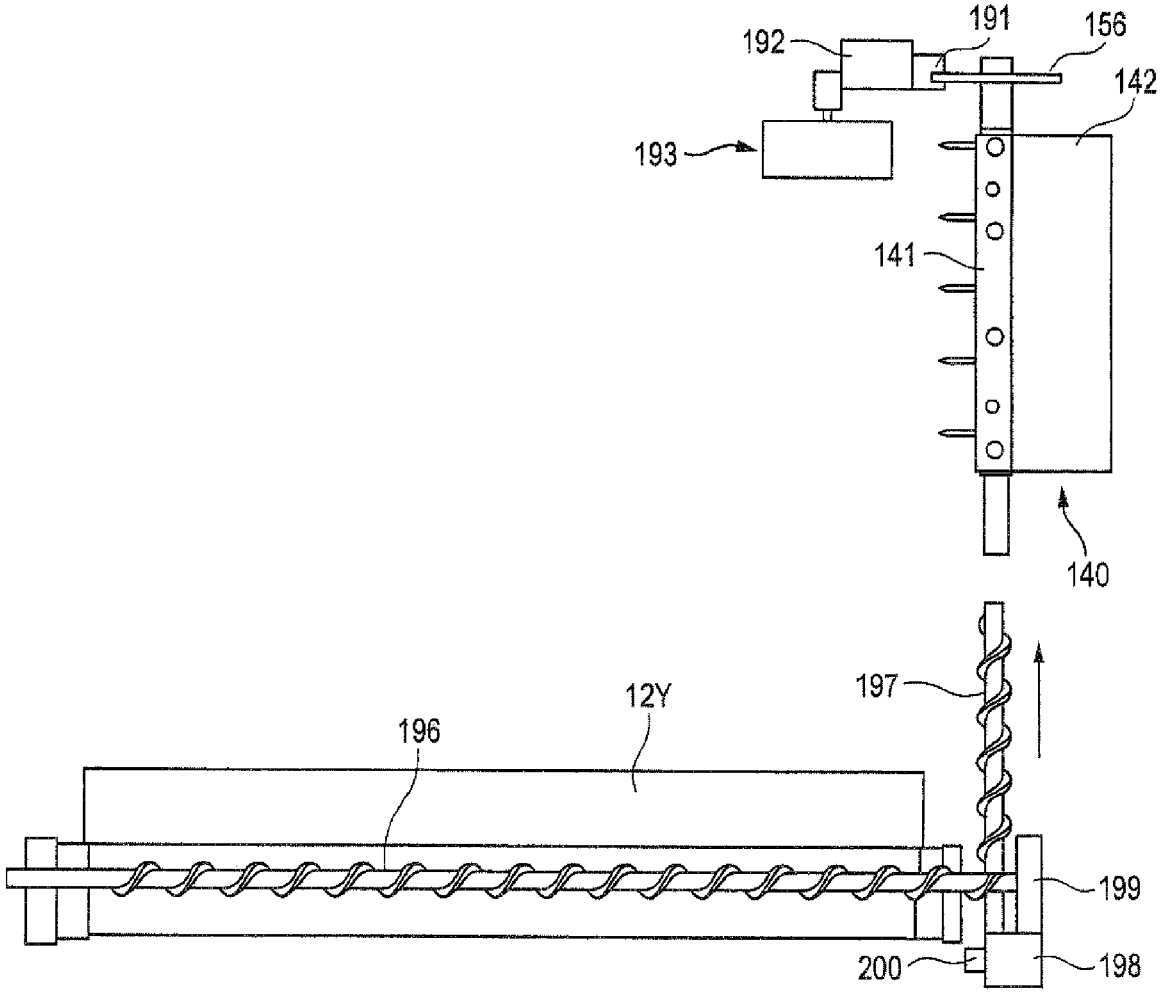
FIG. 22 is a configuration view showing a collection path for collecting toner from a cleaning device into the toner cartridge.
Figure 23:
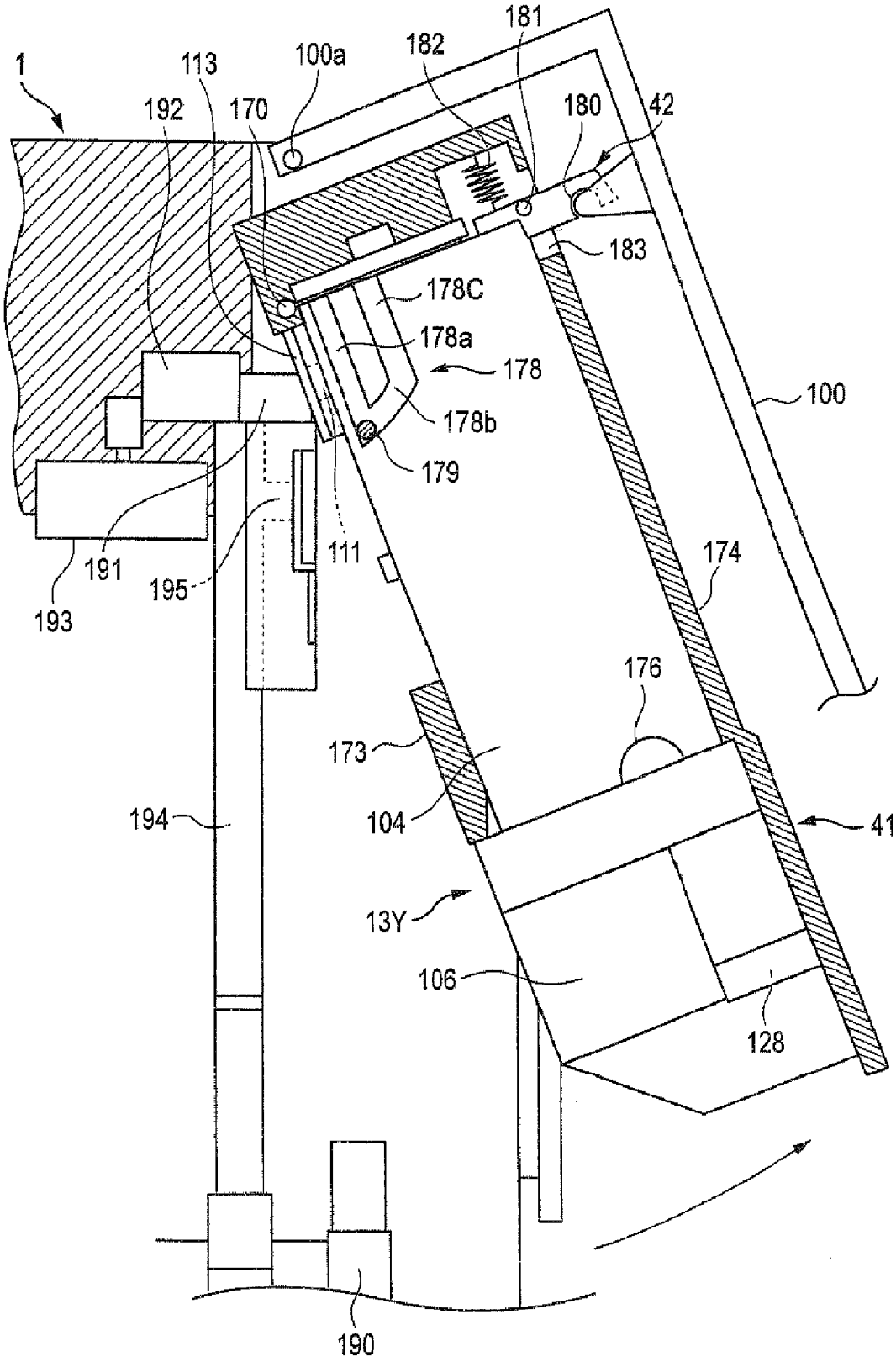
FIG. 23 is a sectional configuration view showing a state of mounting of the toner cartridge.

At predetermined timing, e.g., when the amount of toner collected in the cleaning device 11 reaches a predetermined value as a result of a printing operation as shown in FIG. 2, augers 196 and 197 provided at the printer body 1 for transporting collected toner are driven for rotation by a second driving motor 198 and gears 199 and 200 as shown in FIG. 22. Then, the collected toner is stored in the collected toner-storing portion 103 of the toner cartridge 13 through the waste toner transport path 190 which is formed by a cylindrical member disposed around the auger 197 for transporting collected toner.

In the toner cartridge utilizing the agitator according to the embodiment having the above-described configuration, the structure of the toner cartridge allows the supplied developer-storing portion and the collected developer-storing portion to be separated with the partition member by connecting the supplied developer-storing member and the collected developer-storing member as described below. As a result, the partition member can be disposed with high operability, and assembly and recycling of the cartridge can be performed with ease.

Figure 24A:
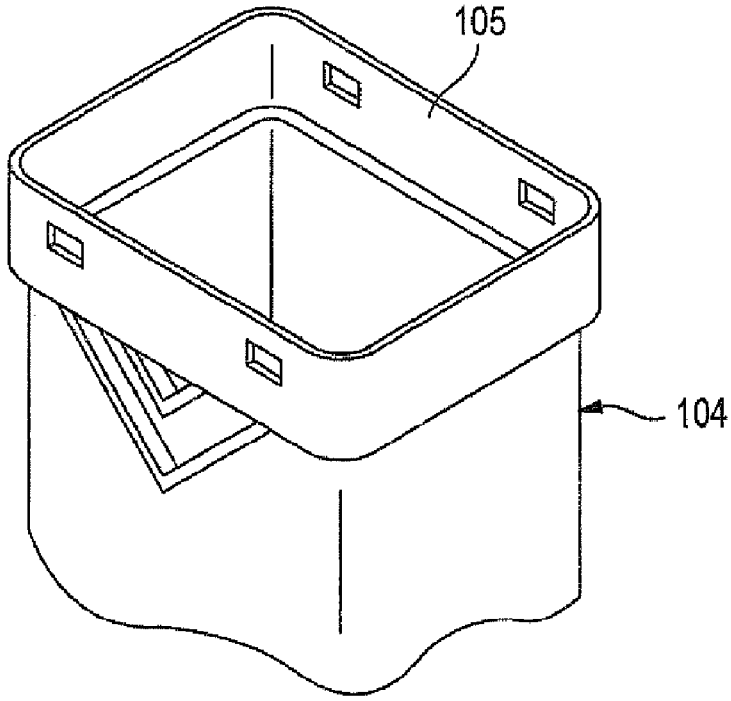
FIGS. 24A and 24B are perspective configuration views showing a step of assembling the toner cartridge as a developer storing container according to an exemplary embodiment of the invention.
Figure 24B:
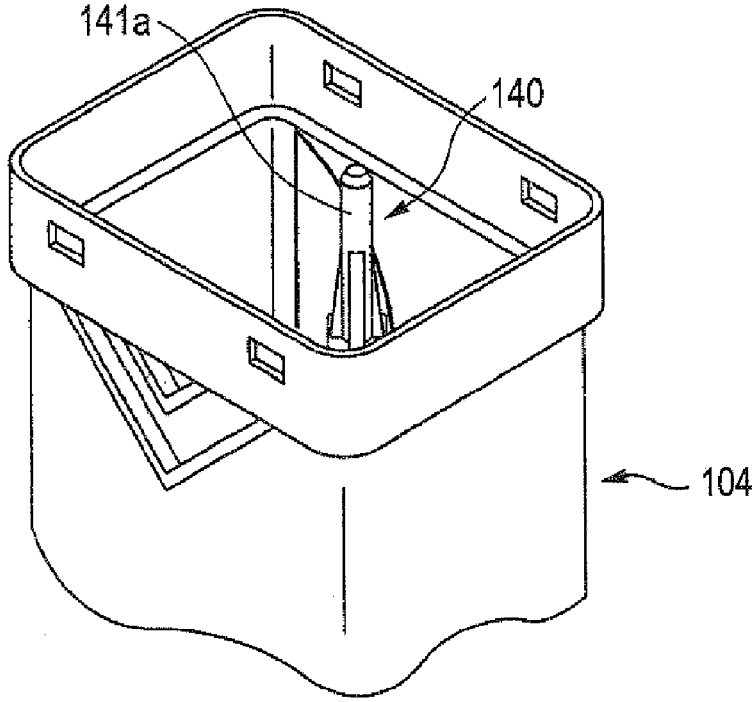

Specifically, when the toner cartridge 13 of the present embodiment is assembled, as shown in FIGS. 1 and 24, the supplied toner-storing container 104 is substantially vertically set in an assembling apparatus, which is not shown, with the opening 105 facing upward, and the agitator shaft 141 is inserted in the supplied toner-storing container 104 through the opening 105. At this time, the tip part 141*a* of the agitator shaft 141 protrudes in a predetermined amount from the top end of the supplied toner-storing portion 102. Obviously, the agitator 140 may be mounted in the supplied toner-storing container 104 in advance before setting the toner cartridge 13 in the assembling apparatus.

Figure 25:
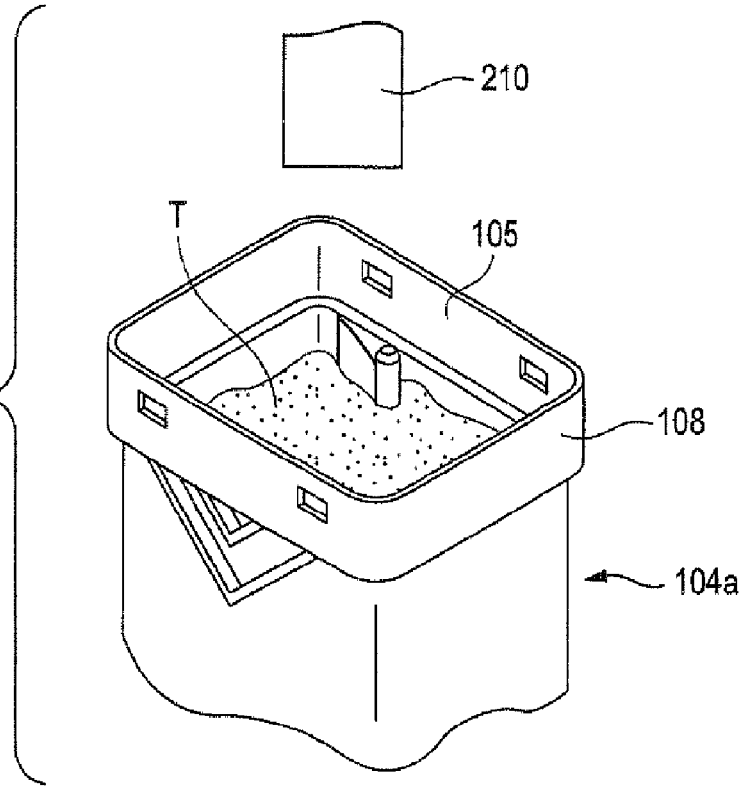
FIG. 25 is a perspective configuration view showing a step of assembling the toner cartridge as a developer storing container according to an exemplary embodiment of the invention.

Then, the supplied toner-storing container 104 is filled with a predetermined amount of fresh toner T supplied through the opening 105 using a toner filling machine as shown in FIG. 25. At this time, since the agitator 140 is accommodated in advance in the supplied toner-storing container 104 to partition the interior of the supplied toner-storing container 104 as shown in FIG. 25, the container is filled with the supplied toner such that the toner is stored on both sides of the agitator 140 as evenly as possible.

Figure 26:
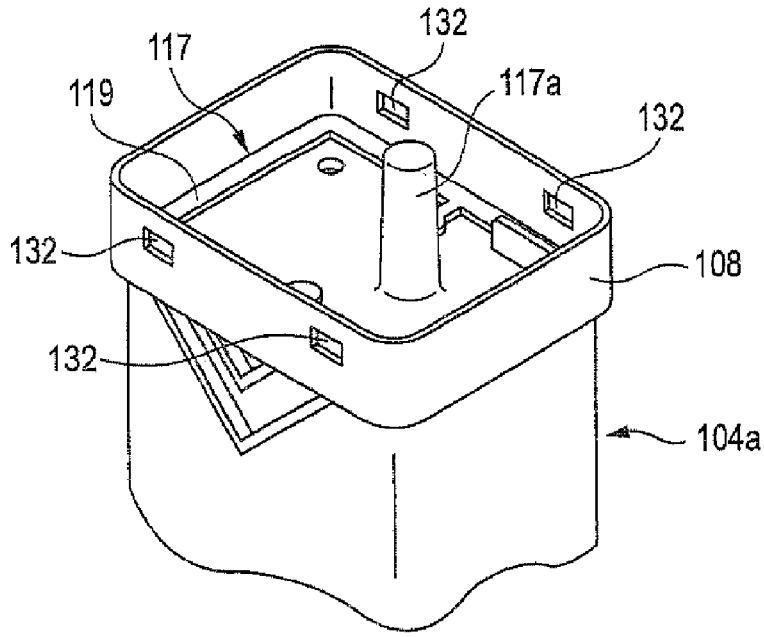
FIG. 26 is a perspective configuration view showing a step of assembling the toner cartridge as a developer storing container according to an exemplary embodiment of the invention.

Thereafter, the partition member is mounted in the supplied toner-storing container 104 through the opening 105 as shown in FIG. 26. At this time, the agitator shaft 141 may be decentered because the container has been filled with the toner T with the shaft 141 cantilevered. Therefore, the partition member is mounted on the step portion 103*a* in the connecting portion 108 of the supplied toner-storing container 104 while gripping the bearing portion of the same formed in a cylindrical shape with the assembling machine to guide it to a right position with the tip part 141*a* of the agitator shaft 141 inserted in the bearing portion 117*a* of the partition member 117.

Figure 27:
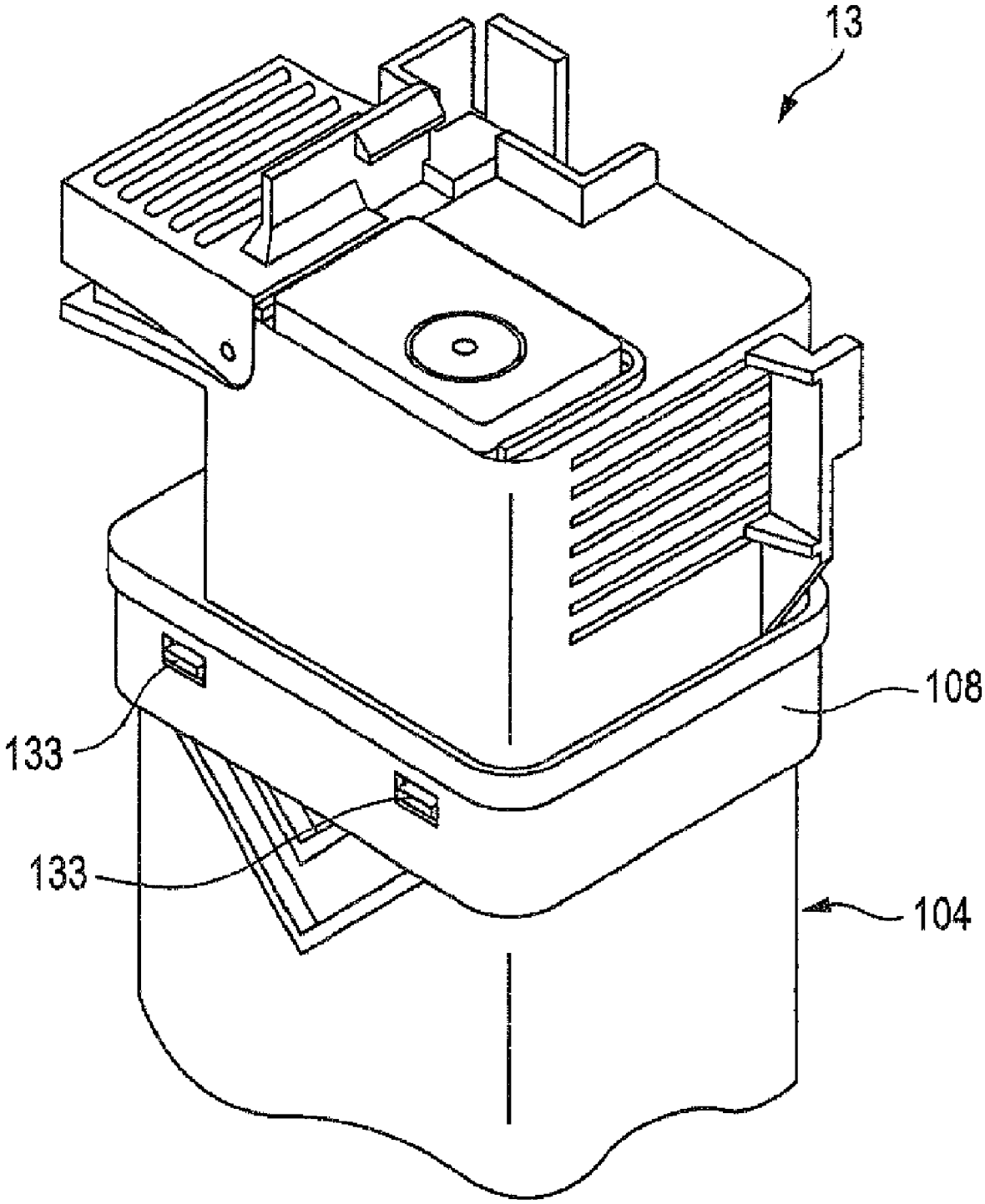
FIG. 27 is a perspective configuration view showing a step of assembling the toner cartridge as a developer storing container according to an exemplary embodiment of the invention.
Figure 28:
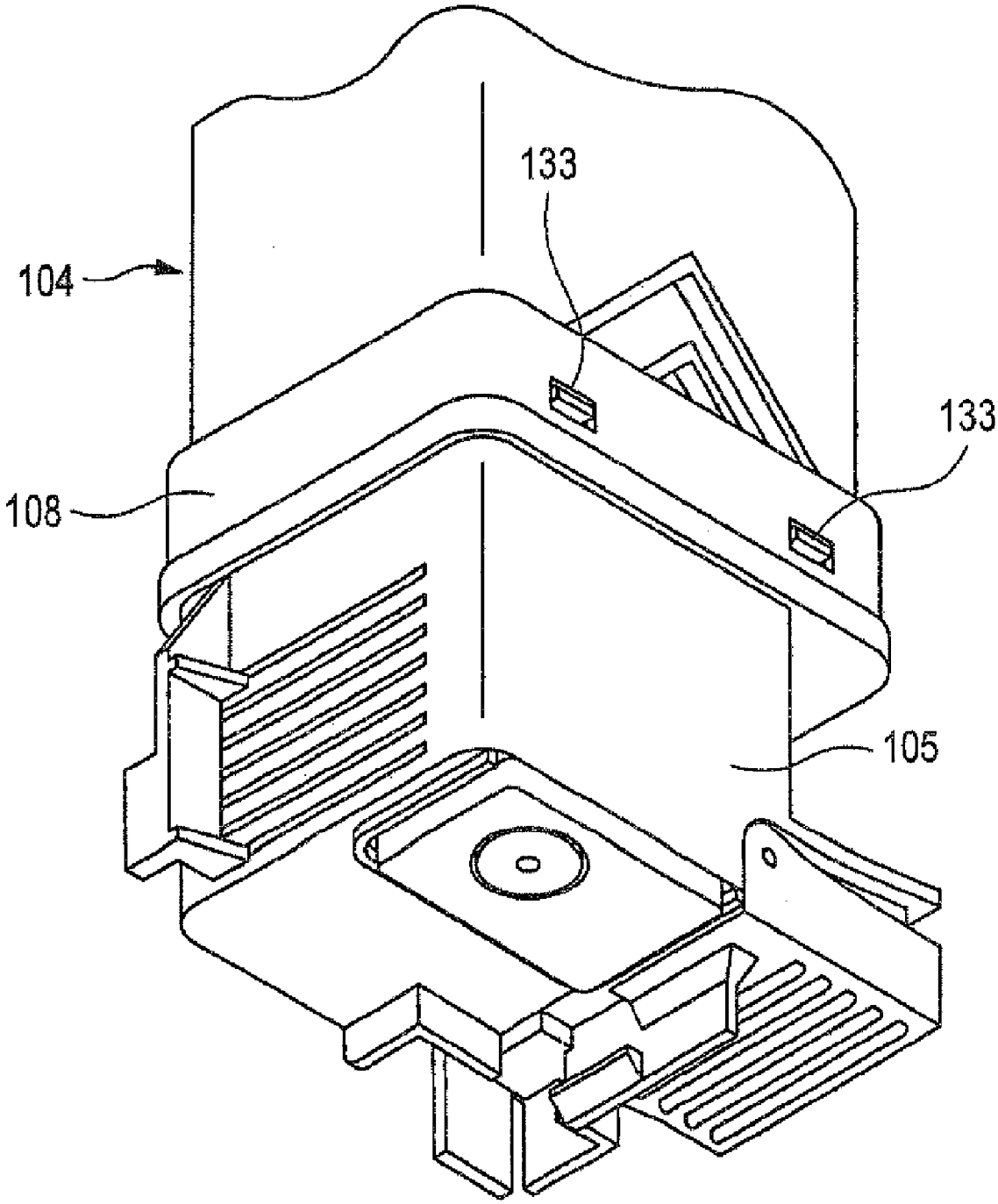
FIG. 28 is a perspective configuration view showing a step of recycling the toner cartridge as a developer storing container according to an exemplary embodiment of the invention.

Next, as shown in FIG. 27, the supplied toner-storing container 104 and the collected toner-storing container 106 are snap-fitted to be integrally connected with each other by engaging the connection holes 132 at the connecting portion 108 of the supplied toner-storing container 104 with the protrusions 133 at the connecting portion 109 of the container 106 with the connecting portion 109 of the collected toner-storing container 106 inserted in the connecting portion of the supplied toner-storing container. As shown in FIG. 8, the partition member 117 is mounted so as to separate the supplied toner-storing portion 102 and the collected toner-storing portion 103 from each other, the partition member being sandwiched between the step portion 108*a* of the supplied toner-storing container 104 and the connecting portion 109 of the collected toner-storing container 106. Thus, the supplied toner-storing portion 102 and the collected toner-storing portion 103 are sealed.

At this time, a double seal is provided by the step portion 108*a* and the connecting portion 108 at the supplied toner-storing portion and by the connecting portion 109 and the connecting portion 108 at the collected toner-staring portion. Further, the seal members 118 and 119 are provided integrally with the partition member 117 at the peripheries of the surfaces thereof facing the supplied toner-storing portion and the collected toner-storing portion, respectively. Therefore, the openings 105 and 107 of the supplied toner-storing portion and the collected toner-storing portion are reliably sealed by the seal members 118 and 119.

Thereafter, the seal 122 is wound around the connecting portions of the supplied toner-storing container 104 and the collected toner-storing container 106 and a label L is applied thereon as shown in FIG. 7, which terminates the assembling step. As thus described, when the toner cartridge is assembled, it is possible to mount the agitator shaft 141, to fill the cartridge with toner T, to dispose the partition member 117, and to connect the collected toner-storing container from one direction.

When a used toner cartridge 13 as described above is recycled at a recycling process, the recycling process is carried out by performing the steps of the assembling process in reverse.

Figure 29:
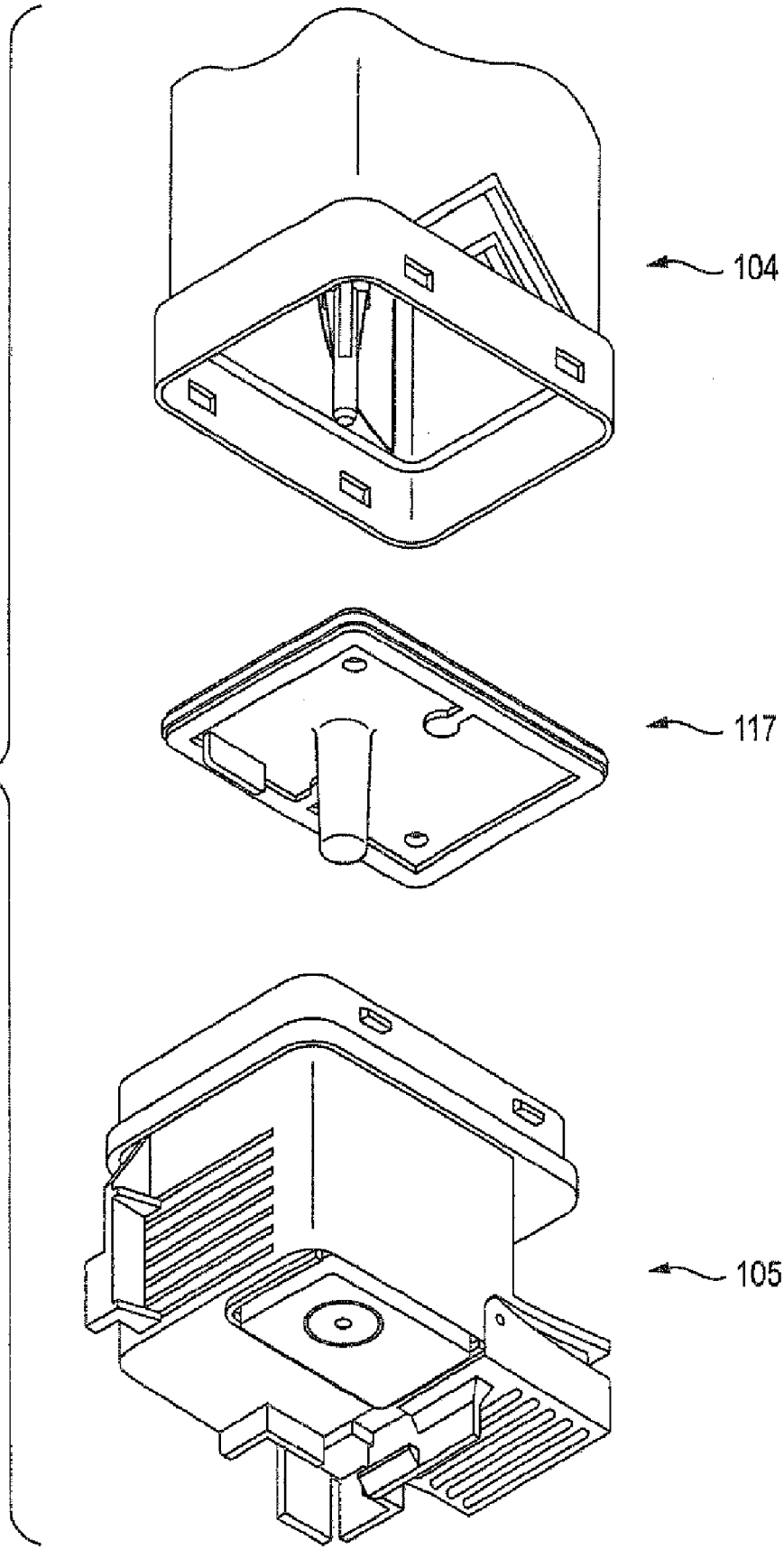
FIG. 29 is a perspective configuration view showing a step of recycling the toner cartridge as a developer storing container according to an exemplary embodiment of the invention.
Figure 30A:
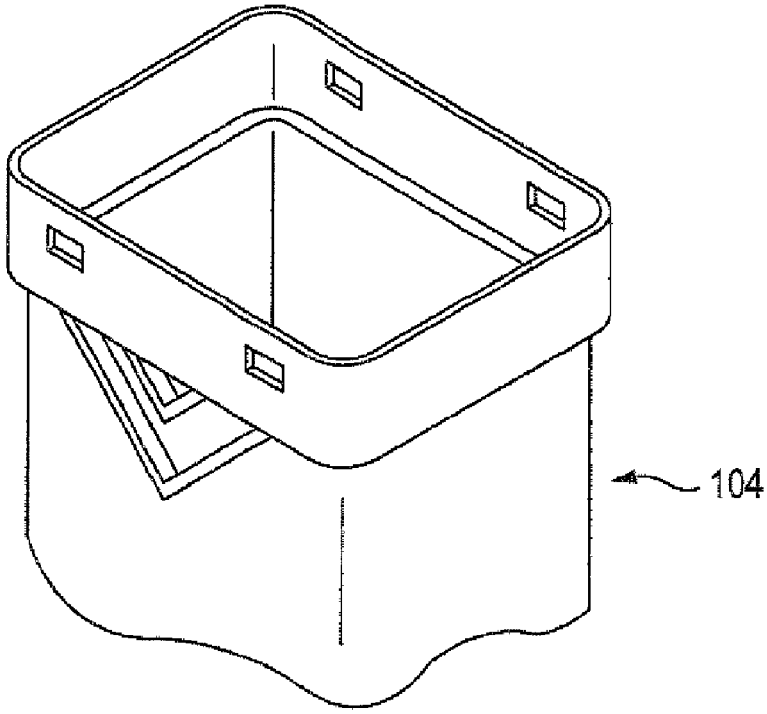
FIGS. 30A and 30B are perspective configuration views showing a step of recycling the toner cartridge as a developer storing container according to an exemplary embodiment of the invention.
Figure 30B:
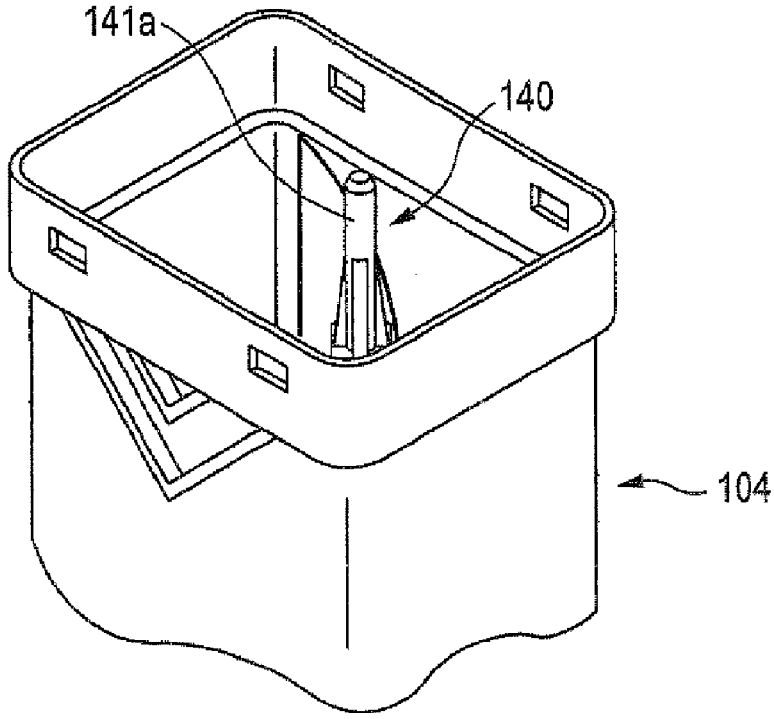

Specifically, the used toner cartridge 13 is disassembled, At the disassembling step, the seal 122 wound around the toner cartridge 13 is first removed; the cartridge is held with a hand or set in a disassembling device (not shown) with the collected toner-storing container 106 located at the bottom; the snap-fit connection between the supplied toner-storing container 104 and the collected toner-storing container 106 is released using a jig such as a screw driver as occasion demands; and the collected toner-storing container 106 is removed from the toner cartridge 13 as shown in FIG. 29. A cleaning step is then performed using an air brush as occasion demands to remove collected toner deposited in the collected toner-storing container 106.

Then, the above-described assembling step is performed. Specifically, as shown in FIGS. 30 to 33, the supplied toner-storing container 104 is substantially vertically set in the assembling device, which is not shown, with the opening 105 facing upward. At this time, the tip portion 141*a* of the agitator 141 protrudes in a predetermined amount from the top end of the supplied toner-storing portion 102.

Figure 31:
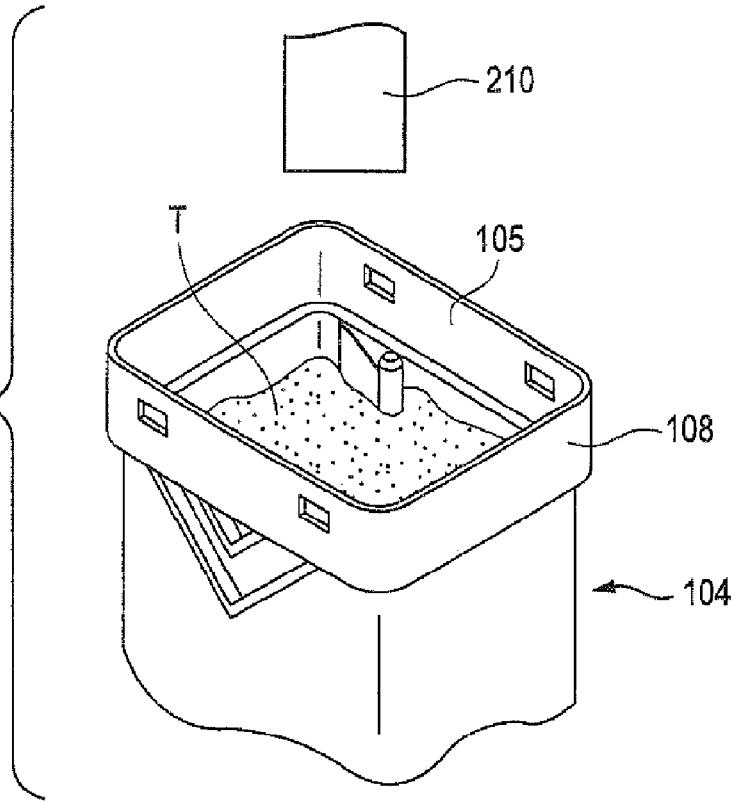
FIG. 31 is a perspective configuration view showing a step of recycling the toner cartridge as a developer storing container according to an exemplary embodiment of the invention.

Then, as shown in FIG. 31, the supplied toner-storing portion 102 is filled with a predetermined amount of fresh toner T supplied through the opening 105 using a toner filling machine 210. At this time, since the agitator 140 is accommodated in advance in the supplied toner-storing container 104 to partition the interior of the supplied toner-storing container 104 as shown in FIG. 25, the container is filled with the supplied toner such that the toner is stored on both sides of the agitator 140 as evenly as possible.

Figure 32:
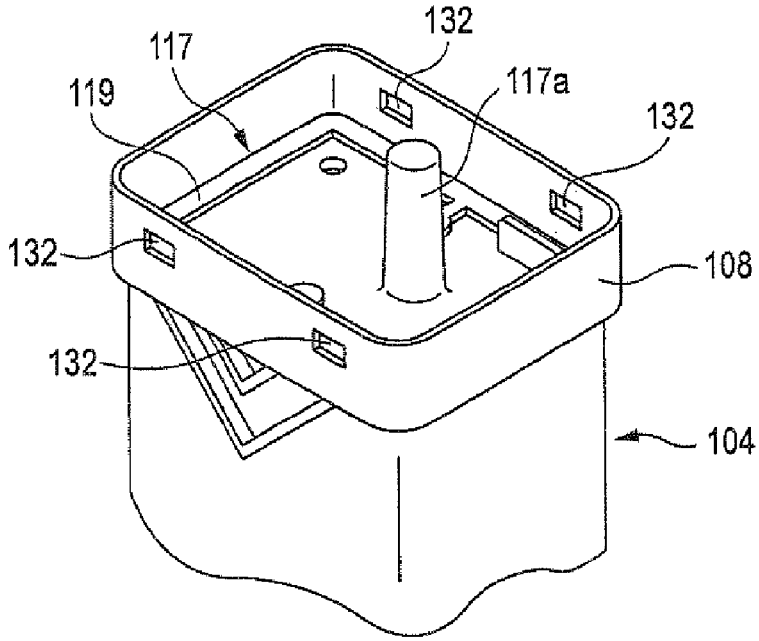
FIG. 32 is a perspective configuration view showing a step of recycling the toner cartridge as a developer storing container according to an exemplary embodiment of the invention.

Thereafter, the partition member is mounted in the supplied toner-storing container 104 as shown in FIG. 32. At this time, the connecting portion 109 of the collected toner-storing container 106 is mounted in the connecting portion 108 of the supplied toner-storing container 104 with the tip part 141*a* of the agitator shaft 141 inserted in the bearing portion 117*a* of the partition member 117 by gripping the bearing portion formed in a cylindrical shape of the partition member with the assembling device.

Figure 33:
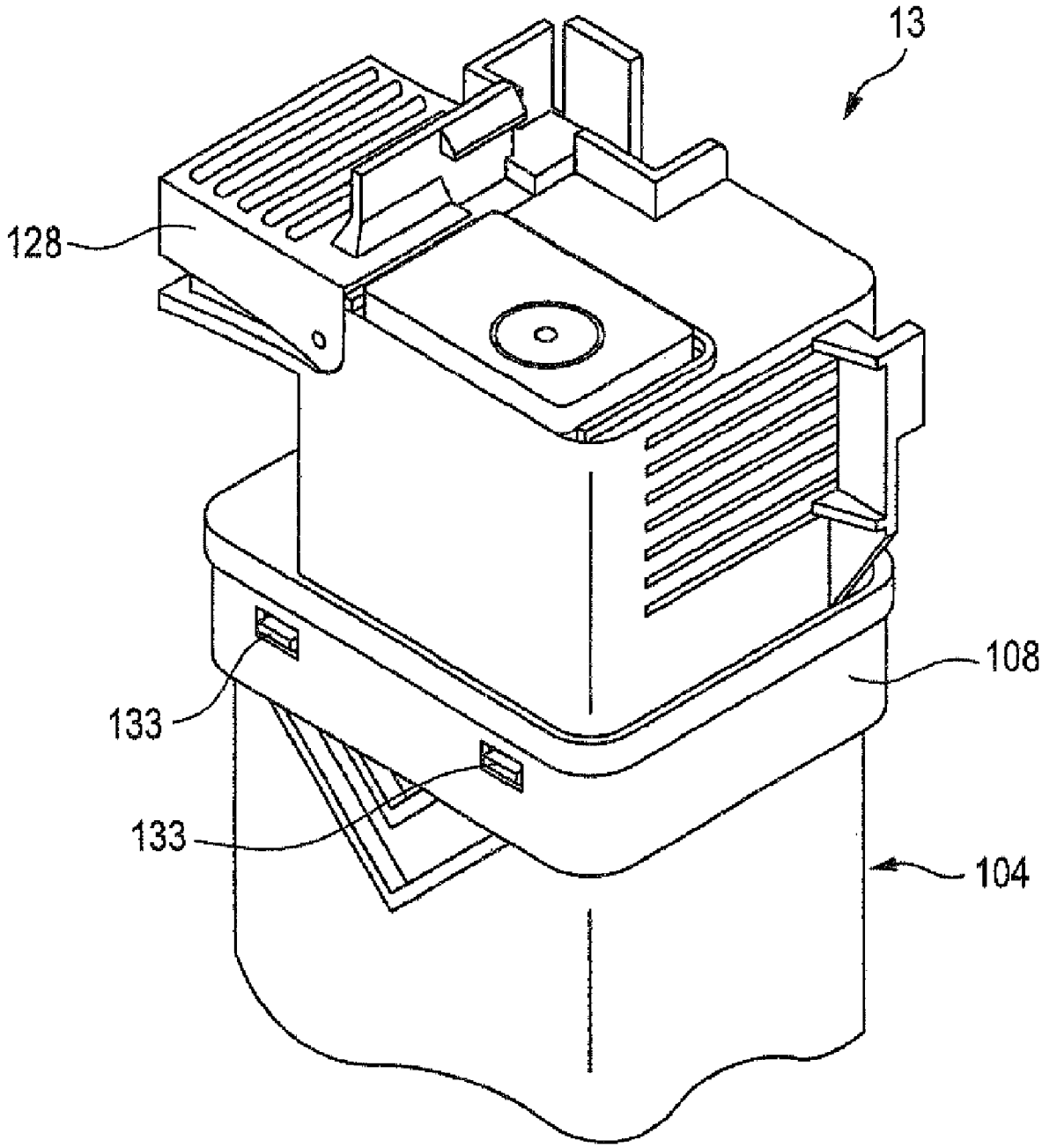
FIG. 33 is a perspective configuration view showing a step of recycling the toner cartridge as a developer storing container according to an exemplary embodiment of the invention.

Next, as shown in FIG. 33, the supplied toner-storing container 104 and the collected toner-storing container 106 are snap-fitted to be integrally connected with each other by engaging the connection holes 132 at the connecting portion 108 of the supplied toner-storing container 104 with the protrusions 133 at the connecting portion 109 of the container 106 with the connecting portion 109 of the collected toner-storing container 106 inserted in the connecting portion of the supplied toner-storing container. As shown in FIG. 8, the partition member 117 is mounted so as to separate the supplied toner-storing portion 102 and the collected toner-storing portion 103 from each other to seal them again, the partition member being sandwiched between the step portion 108*a* of the supplied toner-storing container 104 and the connecting portion 109 of the collected toner-storing container 106.

Thereafter, a seal 122 is wound around the connecting portions of the supplied toner-storing container 104 and the collected toner-storing container 106 and a label L is applied thereon as shown in FIG. 7, which completes the recycling process.

At the recycling process, when there is deformation of, for example, the agitator film 142, a step of replacing or repairing the agitator 140 may be added as occasion demands.

Although an automatic assembling machine is used in the present embodiment, the same steps may be performed manually.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer storing container comprising:

a first storing member including a first storing portion for storing a supplied developer;

a second storing member including a second storing portion for storing a collected developer; and a partition member that connects the first storing portion and the second storing member so as to sandwich the partition member therebetween, and that separates the first and second storing portions from each other, wherein the first and second storing members are discrete structures, wherein the partition member has a first side on which a first sandwiching portion of the first storing member is provided, wherein the partition member has a second side, which is opposite the first side, on which a second sandwiching portion of the second storing member is provided, and wherein the partition member is sandwiched by the first sandwiching portion and the second sandwiching portion so as to seal the first and second storing members.

2. The developer storing container according to claim 1, further comprising a leakage preventing member for preventing a leakage of the supplied developer or the collected developer, the leakage preventing member is placed on a surface of the partition member in contact with the first storing member or the second storing member.

3. The developer storing container according to claim 2, wherein the leakage preventing member is integrated with the partition member.

4. The developer storing container according to claim 1, wherein the first and second storing members are detachably connected to each other.

5. The developer storing container according to claim 1, wherein the partition member includes a bearing portion that rotatably supports a shaft disposed in the first storing member, the shaft being an agitating member for agitating the supplied developer.

6. The developer storing container according to claim 5, wherein the shaft of the agitating member protrudes from the partition member toward the second storing member.

7. The developer storing container according to claim 5, wherein the shaft of the agitating member protrudes from an end of the first storing member toward the second storing member.

8. The developer storing container according to claim 5, wherein the bearing portion for the agitating member also serves as a grip of the partition member.

9. The developer storing container according to claim 1, wherein the partition member includes a transparent portion at least in a part thereof.

10. The developer storing container according to claim 1, wherein the first storing member has a gear for rotating the agitating member on a side thereof opposite to a side where the second storing member is connected.

11. The developer storing container according to claim 1, wherein the partition member has a handle for gripping the partition member.

12. An image forming apparatus comprising a developer storing container according to claim 1, which is detachably mounted in the image forming apparatus.

13. A developer storing container comprising:

a first storing member including a first storing portion for storing a supplied developer;

a second storing member including a second storing portion for storing a collected developer; and a partition member that connects the first storing portion and the second storing member so as to sandwich the partition member therebetween, and that separates the first and second storing portions from each other;

wherein the first and second storing members have respective openings on sides thereof where the first and second storing members face to each other.

14. A developer storing container comprising:

a first storing member including a first storing portion for storing a supplied developer;

a second storing member including a second storing portion for storing a collected developer; and a partition member that connects the first storing portion and the second storing member so as to sandwich the partition member therebetween, and that separates the first and second storing portions from each other;

wherein:

the first storing member includes a first connecting portion, the second storing member includes a second connecting portion, the first and second connecting portions are connected to each other so that the second connecting portion is located inside the first connecting portion;

the first storing member has a step portion between the first connecting portion and the first storing portion; and the partition member is sandwiched by the step portion and the second connecting portion.

15. A method of assembling a developer storing container, comprising:

filling a first storing portion in a first storing member with a developer supplied through an opening of the first storing member;

disposing a partition member on a side of the opening with respect to the supplied developer that fills the first storing portion; and sealing the opening of the first storing member with a second storing member including a second storing portion for storing a collected developer, the second storing member connecting the opening so that the first and second storing member sandwich the partition member.

16. A method of assembling a developer storing container, comprising:

disposing an agitating member in a first storing portion of a first storing member through an opening of a first storing member, the agitating member being for agitating a supplied developer stored in the first storing portion;

filling the first storing portion with a developer supplied through the opening of the first storing member;

disposing a partition member having a bearing portion for pivotally supporting a shaft of the agitating member while guiding the shaft to a mounting position of the shaft, the partition member being disposed on a side of the opening with respect to the supplied developer that fills the supplied developer-storing portion; and sealing the opening of the first storing member with a second storing member including a second storing portion for storing a collected developer, the second storing member connecting the opening so that the first and second storing member sandwich the partition member.

17. A method of recycling a developer storing container, the developer storing container comprising: a first storing member including a first portion that stores a supplied developer; a second storing member including a second storing portion that stores a collected developer; and a partition member separates the first and second storing portions from each other, the method comprising:

removing the second storing member from the developer storing container through an opening of the first storing member;

eliminating the collected developer from the second storing portion;

filling the first storing portion with a developer supplied through the opening of the first storing member;

disposing the partition member on a side of the opening with respect to the supplied developer that fills the first storing portion; and sealing the opening of the first storing member with a second storing member including a second storing portion for storing a collected developer, the second storing member connecting the opening so that the first and second storing member sandwich the partition member.

18. The method of recycling a developer storing container according to claim 17, wherein the filling is performed with an agitating member mounted in the first storing portion, the agitating member agitating the supplied developer in the first storing portion.

19. A method of recycling a developer storing container, the developer storing container comprising: a first storing member including a first portion that stores a supplied developer; a second storing member including a second storing portion that stores a collected developer; and a partition member separates the first and second storing portions from each other, the method comprising:

removing the second storing member from the developer storing container;

eliminating the collected developer from second storing portion;

cleaning the interior of the second storing portion;

filling the first storing portion with a developer supplied through an opening of the first storing member;

disposing the partition member on a side of the opening with respect to the supplied developer that fills the first storing portion; and sealing the opening of the first storing member with a second storing member including a second storing portion for storing a collected developer, the second storing member connecting the opening so that the first and second storing member sandwich the partition member.

20. The method of recycling a developer storing container according to claim 19, wherein the filling is performed with an agitating member mounted in the first storing portion, the agitating member agitating the supplied developer in the first storing portion.

* * * * *